US009502767B2

(12) United States Patent
Stepanenko et al.

(10) Patent No.: US 9,502,767 B2
(45) Date of Patent: Nov. 22, 2016

(54) COMPACT ANTENNA SYSTEM WITH REDUCED MULTIPATH RECEPTION

(71) Applicants: LLC "TOPCON POSITIONING SYSTEMS", Moscow (RU); Anton Pavlovich Stepanenko, Dedovsk (RU); Dmitry Vitalievich Tatarnikov, Moscow (RU); Andrey Vitalievich Astakhov, Moscow (RU)

(72) Inventors: Anton Pavlovich Stepanenko, Dedovsk (RU); Dmitry Vitalievich Tatarnikov, Moscow (RU); Andrey Vitalievich Astakhov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 25 days.

(21) Appl. No.: 14/654,216

(22) PCT Filed: Nov. 22, 2013

(86) PCT No.: PCT/RU2013/001052

§ 371 (c)(1),
(2) Date: Jun. 19, 2015

(87) PCT Pub. No.: WO2015/076691

PCT Pub. Date: May 28, 2015

(65) Prior Publication Data

US 2015/0340763 A1 Nov. 26, 2015

(51) Int. Cl.

| | |
|---|---|
| ***H01Q 1/36*** | (2006.01) |
| ***H01Q 5/321*** | (2015.01) |
| ***H01Q 11/08*** | (2006.01) |

(52) U.S. Cl.

CPC ..... *H01Q 5/321* (2015.01); *H01Q 1/36* (2013.01); *H01Q 11/08* (2013.01)

(58) Field of Classification Search

CPC ..... H01Q 1/36; H01Q 11/08
USPC ..... 343/895, 749
See application file for complete search history.

(56) References Cited

U.S. PATENT DOCUMENTS

| | | | | |
|---|---|---|---|---|
| 6,421,028 | B1 | 7/2002 | Ohgren et al. | |
| 6,653,987 | B1 * | 11/2003 | Lamensdorf | H01Q 1/38 343/853 |
| 6,765,542 | B2 | 7/2004 | McCarthy et al. | |
| 2011/0254755 | A1 * | 10/2011 | DiNallo | H01Q 11/08 343/893 |

FOREIGN PATENT DOCUMENTS

| | | |
|---|---|---|
| RU | 2253170 C2 | 5/2005 |

OTHER PUBLICATIONS

International Search Report and Written Opinion mailed on Aug. 14, 2014, in connection with International Patent Application No. PCT/RU2013/001052, 7 pgs.

* cited by examiner

*Primary Examiner* — Dieu H Duong
(74) *Attorney, Agent, or Firm* — Chiesa Shahinian & Giantomasi PC

(57) ABSTRACT

An antenna is configured to operate with circularly-polarized electromagnetic radiation in a low-frequency band and in a high-frequency band. The antenna comprises a ground plane and a radiator. The radiator comprises four pairs of radiating elements disposed as pairs of spiral segments on a cylindrical surface having a longitudinal axis orthogonal to the ground plane. Each pair of radiating elements comprises a low-frequency radiating element and a high-frequency radiating element. The low-frequency radiating element comprises a low-frequency conductive strip. The high-frequency radiating element comprises an electrically-connected series of at least one high-frequency conductive strip and at least one high-frequency capacitor. The electrical path lengths of the low-frequency radiating elements and the electrical path lengths of the high-frequency radiating elements are equal.

23 Claims, 26 Drawing Sheets

VIEW S

VIEW B

VIEW A

VIEW U

VIEW S

VIEW S
VIEW A $2\pi r_{out}$
$2r_{out}$
$L_{lf}$
$L_{hf}$
$lw_{lf}$
$lw_{hf}$
$\gamma_{lf}$
$\gamma_{hf}$
$\varphi_{hel,lf}$
$\varphi_{hel,hf}$
$h$
$z$
$y$
$\varphi$
0
$\pi/2$
$\pi$
$3\pi/2$
$2\pi$
500
502
502A
502B
503
504
505
506
507
508
501
511
512
512A
512B
513
514
515
516
517
518
302
305
306
307
308
309
310
313
205
207
225

FIG. 10C
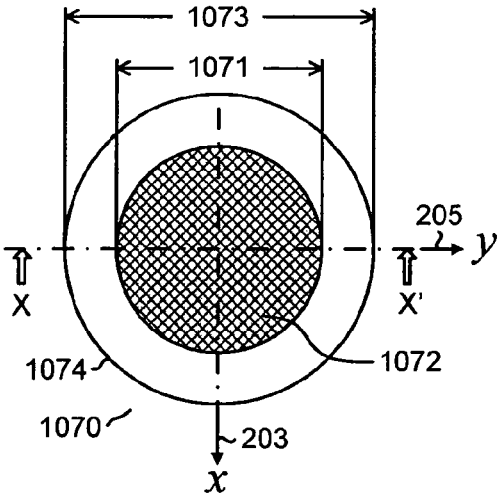
VIEW B
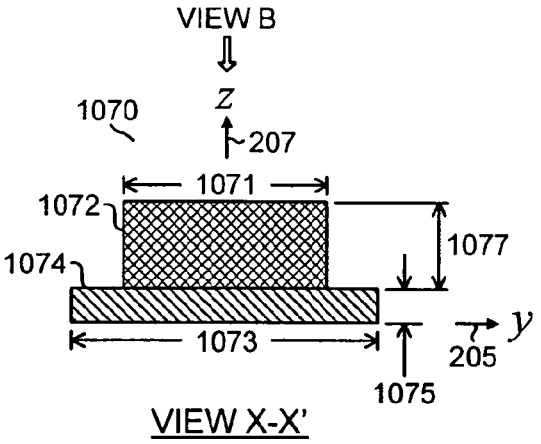
VIEW X-X'
FIG. 10D
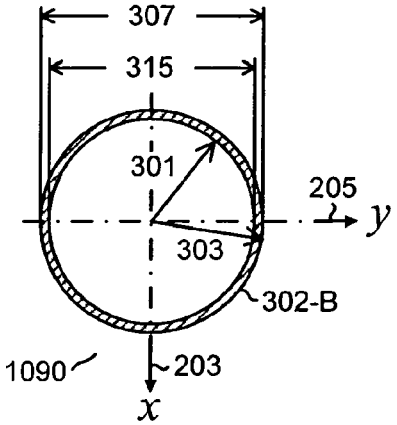
VIEW B
FIG. 10E
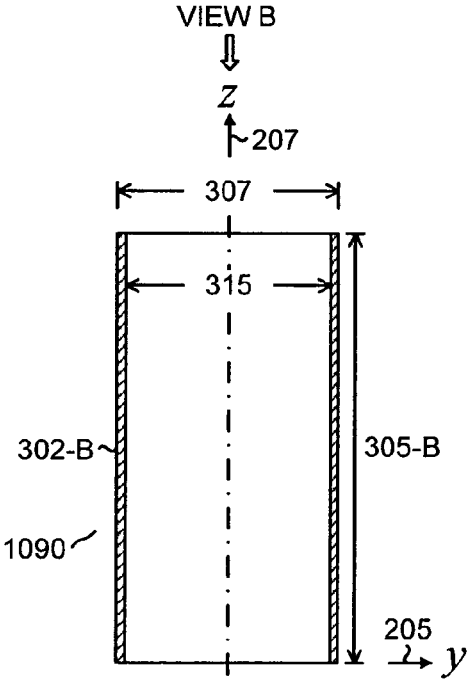
VIEW X-X'
FIG. 10F FIG. 12B
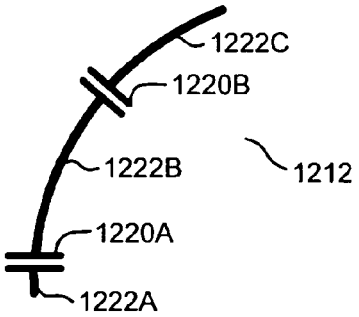
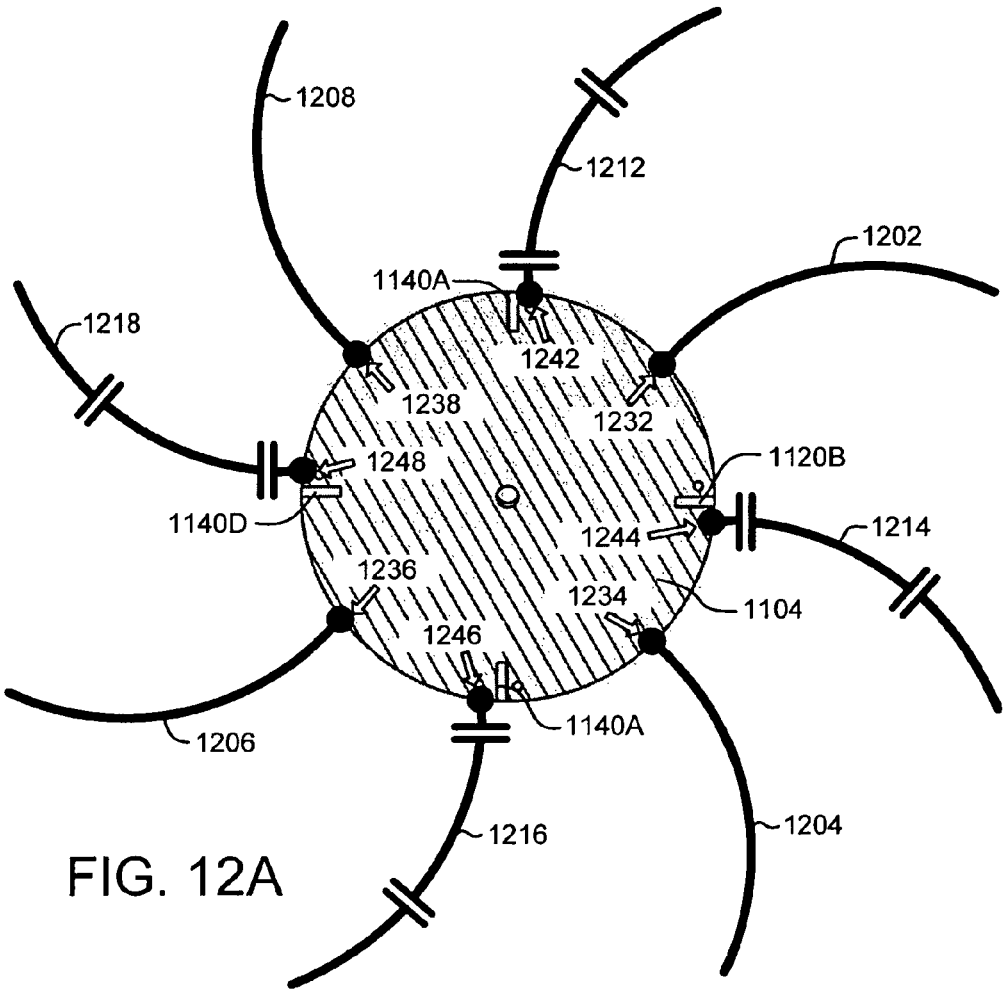
FIG. 12A

VIEW C

VIEW C

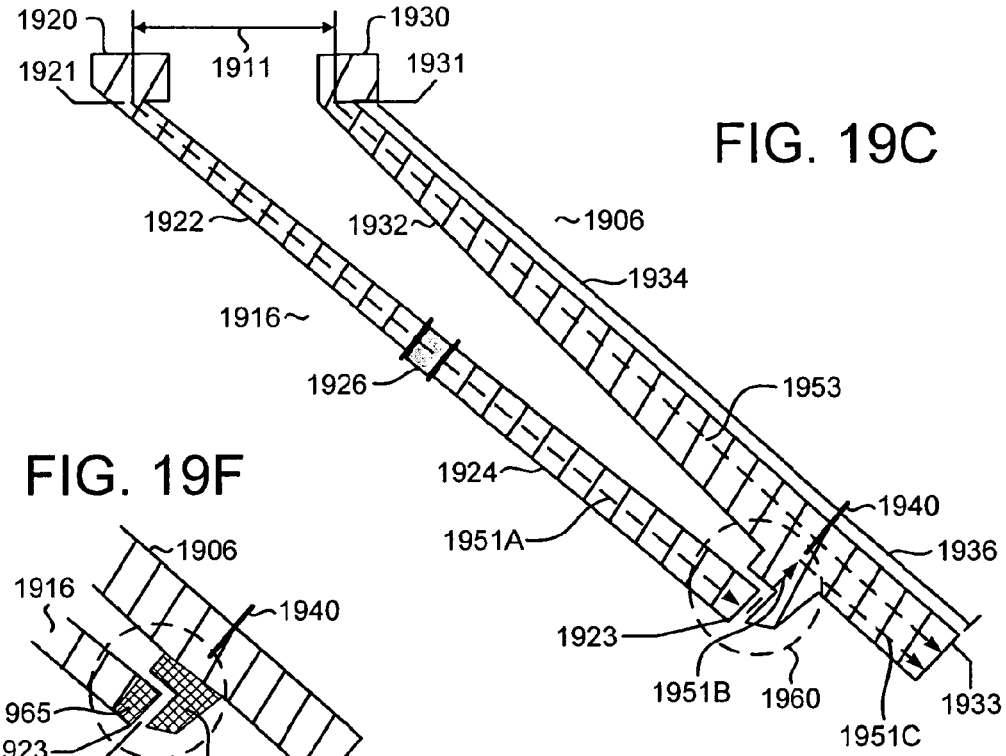
FIG. 19C
FIG. 19F
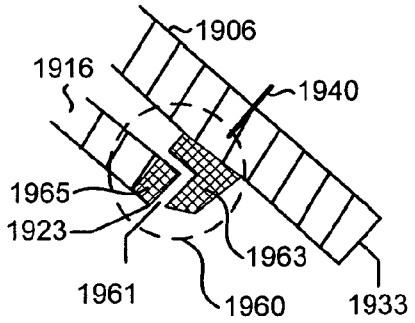
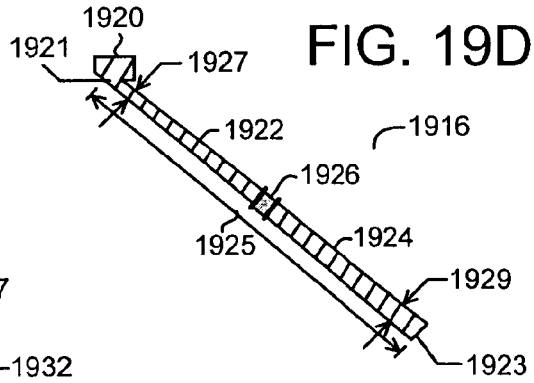
FIG. 19D
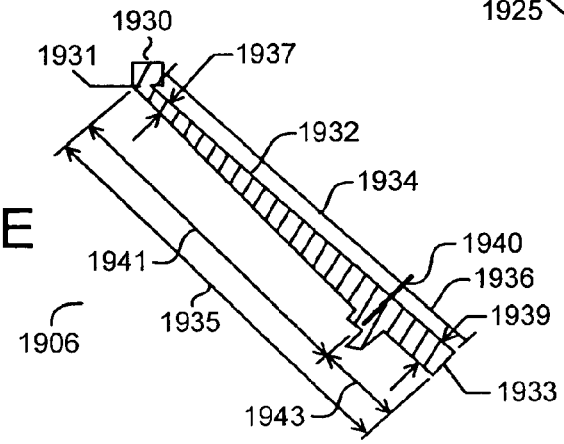
FIG. 19E

COMPACT ANTENNA SYSTEM WITH REDUCED MULTIPATH RECEPTION

CROSS-REFERENCE TO RELATED APPLICATIONS

This application is a national stage (under 35 U.S.C. 371) of International Patent Application No. PCT/RU2013/001052, filed Nov. 22, 2013, which is herein incorporated by reference in its entirety.

BACKGROUND OF THE INVENTION

The present invention relates generally to antennas, and more particularly to antennas for global navigation satellite systems.

Global navigation satellite systems (GNSSs) can determine locations with high accuracy. Currently deployed global navigation satellite systems are the United States Global Positioning System (GPS) and the Russian GLONASS. Other global navigation satellite systems, such as the European GALILEO system, are under development. In a GNSS, a navigation receiver receives and processes radio signals transmitted by satellites located within a line-of-sight of the receiver. The satellite signals comprise carrier signals modulated by pseudo-random binary codes. The receiver measures the time delays of the received signals relative to a local reference clock or oscillator. Code measurements enable the receiver to determine the pseudo-ranges between the receiver and the satellites. The pseudo-ranges differ from the actual ranges (distances) between the receiver and the satellites due to various error sources and due to variations in the time scales of the satellites and the receiver. If signals are received from a sufficiently large number of satellites, then the measured pseudo-ranges can be processed to determine the code coordinates and coordinate time scales at the receiver. This operational mode is referred to as a stand-alone mode, since the measurements are determined by a single receiver. A stand-alone system typically provides meter-level accuracy.

To improve the accuracy, precision, stability, and reliability of measurements, differential navigation (DN) systems have been developed. In a DN system, the position of a user is determined relative to a reference base station. The reference base station is typically fixed, and the coordinates of the reference base station are precisely known; for example, by surveying. The reference base station contains a navigation receiver that receives satellite signals and that can determine the coordinates of the reference base station by GNSS measurements.

The user, whose position is to be determined, can be stationary or mobile; in a DN system, the user is often referred to as a rover. The rover also contains a navigation receiver that receives satellite signals. Signal measurements processed at the reference base station are transmitted to the rover via a communications link. To accommodate a mobile rover, the communications link is often a wireless link. The rover processes the measurements received from the reference base station, along with measurements taken with its own receiver, to improve the accuracy of determining its position. Accuracy is improved in the differential navigation mode because errors incurred by the receiver at the rover and by the receiver at the reference base station are highly correlated. Since the coordinates of the reference base station are accurately known, measurements from the reference base station can be used to compensate for the errors at the rover. A differential global positioning system (DGPS) computes positions based on pseudo-ranges only.

The position determination accuracy of a differential navigation system can be further improved by supplementing the code pseudo-range measurements with measurements of the phases of the satellite carrier signals. If the carrier phases of the signals transmitted by the same satellite are measured by both the navigation receiver in the reference base station and the navigation receiver in the rover, processing the two sets of carrier phase measurements can yield a position determination accuracy to within a fraction of the carrier's wavelength: accuracies on the order of 1-2 cm can be attained. A differential navigation system that computes positions based on real-time carrier signals, in addition to the code pseudo-ranges, is often referred to as a real-time kinematic (RTK) system.

Signal processing techniques can correct certain errors and improve the position determination accuracy. A major source of the uncorrected errors is multipath reception by the receiving antenna. In addition to receiving direct signals from the satellites, the antenna receives signals reflected from the environment around the antenna. The reflected signals are processed along with the direct signals and cause errors in the time delay measurements and errors in the carrier phase measurements. These errors subsequently cause errors in position determination. An antenna that strongly suppresses the reception of multipath signals is therefore desirable.

Each navigation satellite in a global navigation satellite system can transmit circularly polarized signals on one or more frequency bands (for example, on the L1, L2, and L5 frequency bands). A single-band navigation receiver receives and processes signals on one frequency band (such as L1); a dual-band navigation receiver receives and processes signals on two frequency bands (such as L1 and L2); and a multi-band navigation receiver receives and processes signals on three or more frequency bands (such as L1, L2, and L5). A single-system navigation receiver receives and processes signals from a single GNSS (such as GPS); a dual-system navigation receiver receives and process signals from two GNSSs (such as GPS and GLONASS); and a multi-system navigation receiver receives and processes signals from three or more systems (such as GPS, GLONASS, and GALILEO). The operational frequency bands can be different for different systems. An antenna that receives signals over the full frequency range assigned to GNSSs is therefore desirable The full frequency range assigned to GNSSs is divided into two frequency bands: the low-frequency band (1165-1300 MHz) and the high-frequency band (1525-1605 MHz).

For portable navigation receivers, compact size and light weight are important design factors. Low-cost manufacture is usually an important factor for commercial products. For a GNSS navigation receiver, therefore, an antenna with the following design factors would be desirable: circular polarization; operating frequency over the low-frequency band (about 1165-1300 MHz) and the high-frequency band (about 1525-1605 MHz); strong suppression of multipath signals; compact size; light weight; and low manufacturing cost.

BRIEF SUMMARY OF THE INVENTION

An antenna is configured to operate with circularly-polarized electromagnetic radiation in a low-frequency band and in a high-frequency band. The antenna comprises a ground plane and a radiator. The radiator comprises four pairs of radiating elements disposed as four pairs of spiral segments on a cylindrical surface having a longitudinal axis orthogonal to the ground plane. Each pair of radiating elements comprises a low-frequency radiating element and a high-frequency radiating element. The low-frequency radiating element comprises a low-frequency conductive strip. The high-frequency radiating element comprises an electrically-connected series of at least one high-frequency conductive strip and at least one high-frequency capacitor. The electrical path lengths of the low-frequency radiating elements and the electrical path lengths of the high-frequency radiating elements are equal.

In an embodiment, the electrical path length of the low-frequency radiating element is equal to the length of the low-frequency radiating element, and the electrical path length of the high-frequency radiating element is equal to the length of the high-frequency radiating element.

In another embodiment, the low-frequency radiating element further comprises a combined-frequency conductive strip electrically connected in series with the low-frequency conductive strip. The electrical path length of the low-frequency radiating element is equal to the sum of the low-frequency conductive strip and the length of the combined-frequency conductive strip. The high-frequency radiating element further comprises a coupling capacitor and the combined-frequency conductive strip. The electrically-connected series of at least one high-frequency conductive strip and at least one high-frequency capacitor, the coupling capacitor, and the combined-frequency conductive strip are electrically connected in series. The electrical path length of the high-frequency radiating element is equal to the sum of the length of the electrically-connected series of at least one high-frequency conductive strip and at least one high-frequency capacitor, the length of the coupling capacitor, and the length of the combined-frequency conductive strip.

These and other advantages of the invention will be apparent to those of ordinary skill in the art by reference to the following detailed description and the accompanying drawings.

BRIEF DESCRIPTION OF THE DRAWINGS

FIG. 4A and FIG. 4B show schematics of a prior-art single-band radiator;

FIG. 10A-FIG. 10G show schematics of a dual-band antenna, according to an embodiment of the invention;

FIG. 12A and FIG. 12B show schematics of electrical connections between radiating elements and a ground plane;

FIG. 19A-FIG. 19F show schematics of a dual-band antenna, according to an embodiment of the invention.

DETAILED DESCRIPTION

Figure 1:
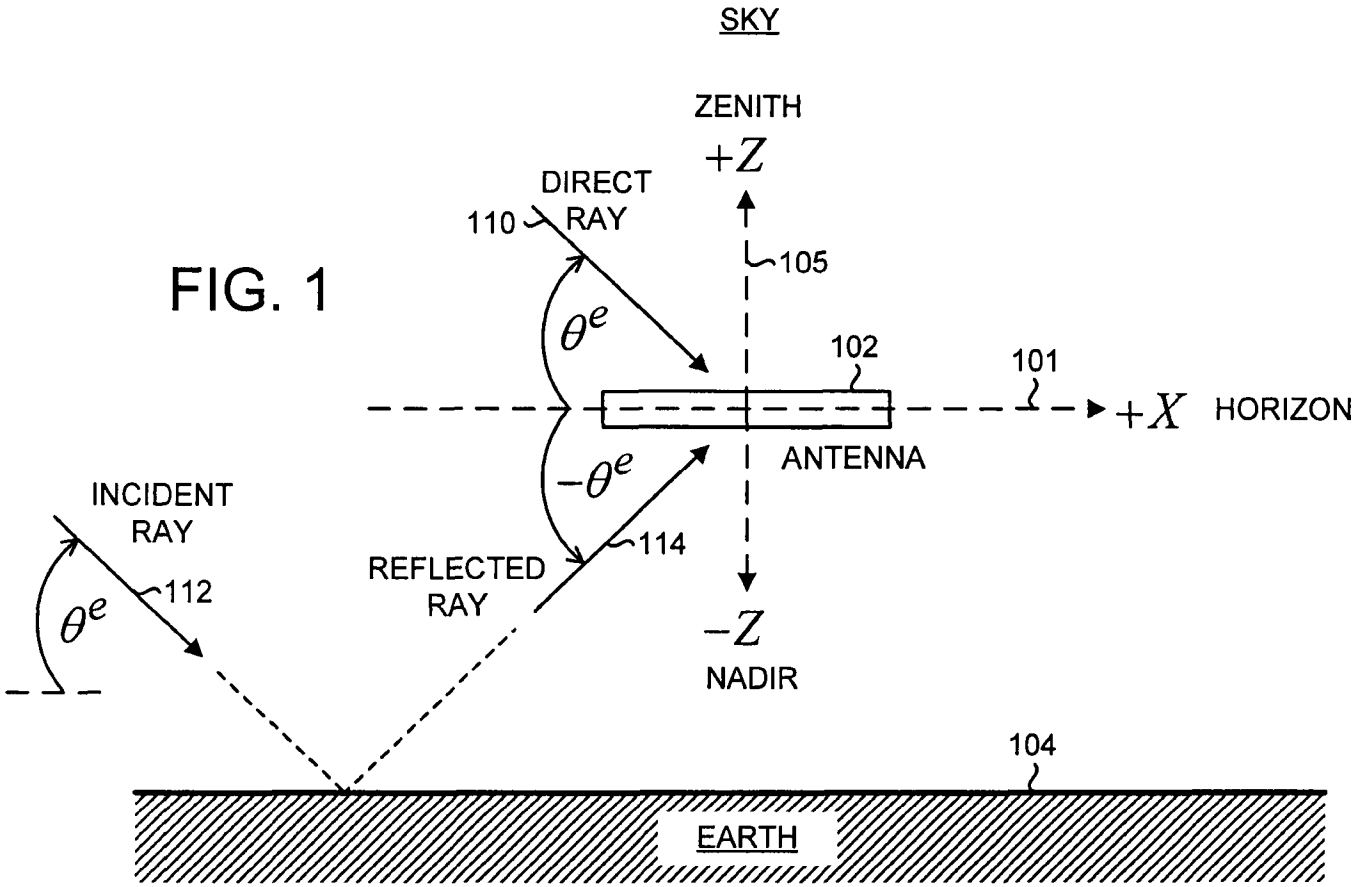
FIG. 1 shows a schematic of the direct signal region and the multipath signal region.

FIG. 1 shows a schematic of an antenna 102 positioned above the Earth 104. Herein, the term Earth includes both land and water environments. To avoid confusion with "electrical" ground (as used in reference to a ground plane), "geographical" ground (as used in reference to land) is not used herein. To simplify the drawing, supporting structures for the antenna are not shown. Shown is a reference Cartesian coordinate system with X-axis 101 and Z-axis 105. The Y-axis (not shown) points into the plane of the figure. In an open-air environment, the +Z (up) direction, referred to as the zenith, points towards the sky, and the −Z (down) direction, referred to as the nadir, points towards the Earth. The X-Y plane lies along the local horizon plane.

In FIG. 1, electromagnetic waves are represented by rays with an elevation angle $\theta^e$ with respect to the horizon. The horizon corresponds to $\theta^e=0$ deg; the zenith corresponds to $\theta^e=+90$ deg; and the nadir corresponds to $\theta^e=-90$ deg. Rays incident from the open sky, such as ray 110 and ray 112, have positive values of elevation angle. Rays reflected from the Earth 104, such as ray 114, have negative values of elevation angle. Herein, the region of space with positive values of elevation angle is referred to as the direct signal region and is also referred to as the forward (or top) hemisphere. Herein, the region of space with negative values of elevation angle is referred to as the multipath signal region and is also referred to as the backward (or bottom) hemisphere. Ray 110 impinges directly on the antenna 102 and is referred to as the direct ray 110; the angle of incidence of the direct ray 110 with respect to the horizon is $\theta^e$. Ray 112 impinges directly on the Earth 104; the angle of incidence of the ray 112 with respect to the horizon is $\theta^e$. Assume ray 112 is specularly reflected. Ray 114, referred to as the reflected ray 114, impinges on the antenna 102; the angle of incidence of the reflected ray 114 with respect to the horizon is $-\theta^e$.

To numerically characterize the capability of an antenna to mitigate the reflected signal, the following ratio is commonly used:

$$DU(\theta^e) = \frac{F(-\theta^e)}{F(\theta^e)}. \tag{E1}$$

The parameter $DU(\theta^e)$ (down/up ratio) is equal to the ratio of the antenna pattern level $F(-\theta^e)$ in the backward hemisphere to the antenna pattern level $F(\theta^e)$ in the forward hemisphere at the mirror angle, where F represents a voltage level. Expressed in dB, the ratio is:

$$DU(\theta^e)\ \text{dB}=20 \log DU(\theta^e). \tag{E2}$$

A commonly used characteristic parameter is the down/up ratio at $\theta^e$=+90 deg:

$$DU_{90} = DU(\theta^e = 90°) = \frac{F(-90°)}{F(90°)}. \quad \text{(E3)}$$

In embodiments of antenna systems described herein, geometrical conditions are satisfied if they are satisfied within specified tolerances; that is, ideal mathematical conditions are not implied. The tolerances are specified, for example, by an antenna engineer. The tolerances are specified depending on various factors, such as available manufacturing tolerances and trade-offs between performance and cost. As examples, two lengths are equal if they are equal to within a specified tolerance, two planes are parallel if they are parallel within a specified tolerance, and two lines are orthogonal if the angle between them is equal to 90 deg within a specified tolerance. Similarly, geometrical shapes such as circles and cylinders have associated "out-of-round" tolerances.

For global navigation satellite system (GNSS) receivers, the antenna is operated in the receive mode (receive electromagnetic radiation). Following standard antenna engineering practice, however, antenna performance characteristics are specified in the transmit mode (transmit electromagnetic radiation). This practice is well accepted because, according to the well-known antenna reciprocity theorem, antenna performance characteristics in the receive mode correspond to antenna performance characteristics in the transmit mode.

Figure 2:
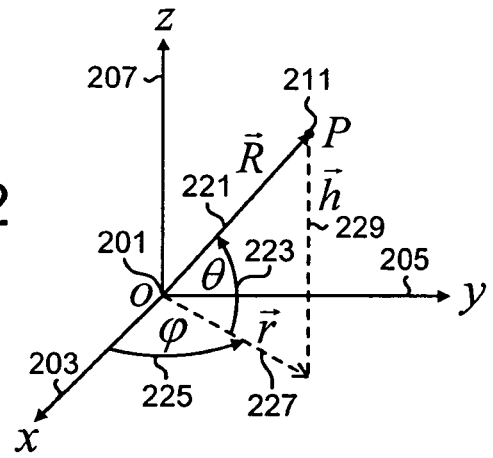
FIG. 2 shows a schematic of reference coordinate systems.

The geometry of antenna systems is described with respect to the Cartesian coordinate system shown in FIG. 2 (perspective view). The Cartesian coordinate system has origin o 201, x-axis 203, y-axis 205, and z-axis 207. The coordinates of the point P 211 are then P(x,y,z). Let $\vec{R}$ 221 represent the vector from o to P. The vector $\vec{R}$ can be decomposed into the vector $\vec{r}$ 227 and the vector $\vec{h}$ 229, where $\vec{r}$ is the projection of $\vec{R}$ onto the x-y plane and $\vec{h}$ is the projection of $\vec{R}$ onto the Z-axis.

The coordinates of P can also be expressed in the spherical coordinate system and in the cylindrical coordinate system. In the spherical coordinate system, the coordinates of P are P(R,θ,ϕ), where R=$|\vec{R}|$ is the radius, θ 223 is the polar angle measured from the x-y plane, and ϕ 225 is the azimuthal angle measured from the X-axis. In the cylindrical coordinate system, the coordinates of P are P(r,ϕ,h), where r=$|\vec{r}|$ is the radius, ϕ is the azimuthal angle, and h=$|\vec{h}|$ is the height measured parallel to the Z-axis. In the cylindrical coordinate axis, the Z-axis axis is referred to as the longitudinal axis. In geometrical configurations that are azimuthally symmetric about the z-axis, the z-axis is referred to as the longitudinal axis of symmetry, or simply the axis of symmetry if there is no other axis of symmetry under discussion.

The polar angle θ is more commonly measured down from the +z-axis (0≤θ≤π). Here, the polar angle θ 223 is measured from the x-y plane for the following reason. If the z-axis 207 refers to the z-axis of an antenna system, and the z-axis 207 is aligned with the geographic Z-axis 105 in FIG. 1, then the polar angle θ 223 will correspond to the elevation angle $\theta^e$ in FIG. 1; that is, −90°≤θ≤+90°, where θ=0° corresponds to the horizon, θ=+90° corresponds to the zenith, and θ=90° corresponds to the nadir.

Figure 3A:
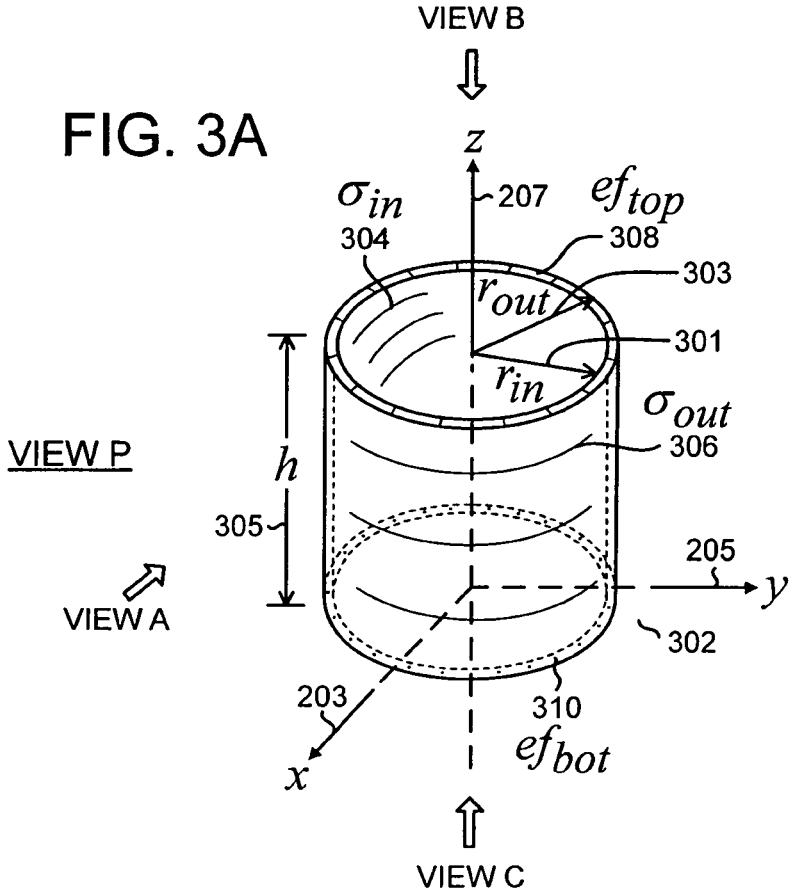
FIG. 3A-FIG. 3E show schematics of reference views for a cylindrical tube.

Embodiments of antenna systems described herein have a component with the geometry of a cylindrical tube. FIG. 3A-FIG. 3E show various reference views for a cylindrical tube. FIG. 3A shows a perspective view (View P) of the cylindrical tube 302. The longitudinal axis is the z-axis 207. The cylindrical tube 302 has the outer surface (wall) $\sigma_{out}$ 306, the inner surface (wall) $\sigma_{in}$ 304, the top end face (also referred to as the first end face) $ef_{top}$ 308, and the bottom end face (also referred to as the second end face) $ef_{bot}$ 310. The plane of the top end face and the plane of the bottom end face are each orthogonal to the longitudinal axis. The dimensions of the cylindrical tube are given by the outer radius $r_{out}$ 303, the inner radius $r_{in}$ 301, and the height h 305. The outer radius is the distance, measured orthogonal to the longitudinal axis, from the longitudinal axis to the outer surface. The inner radius is the distance, measured orthogonal to the longitudinal axis, from the longitudinal axis to the inner surface. The height is the distance, measured along the longitudinal axis, from the bottom end face to the top end face.

Figure 3B:
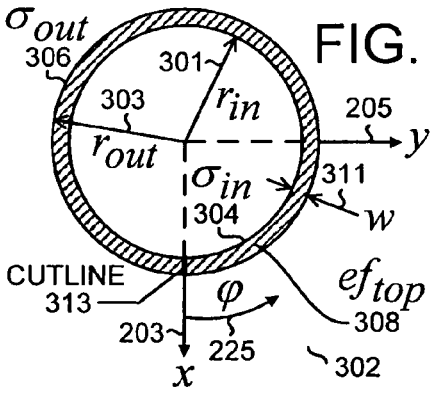
Figure 3C:
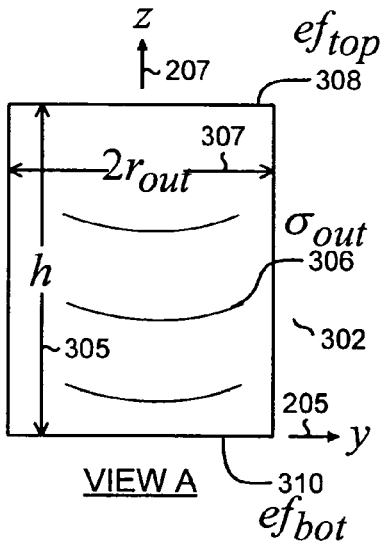

FIG. 3B shows View B, sighted along the −z-axis, of the cylindrical tube 302. In addition to the features described above in reference to FIG. 3A, FIG. 3B shows the wall thickness w 311, where w=$r_{out}$−$r_{in}$. FIG. 3C shows View A, sighted along the −x-axis, of the cylindrical tube 302. In this view, note that the outer surface $\sigma_{out}$ 306 represents a curved surface, not a planar projection. In this view, the dimensions are the height h 305, measured parallel to the z-axis, and the width 307 ($2r_{out}$), measured parallel to the y-axis.

Figure 3D:
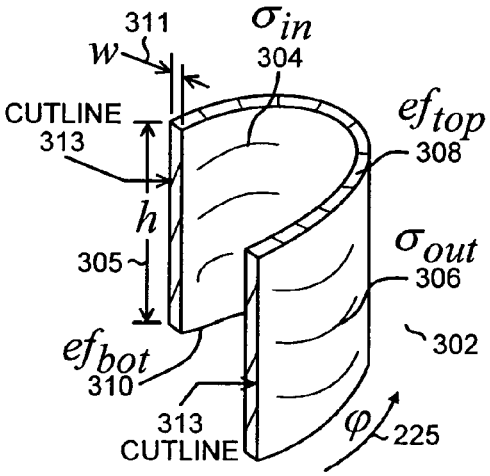
Figure 3E:
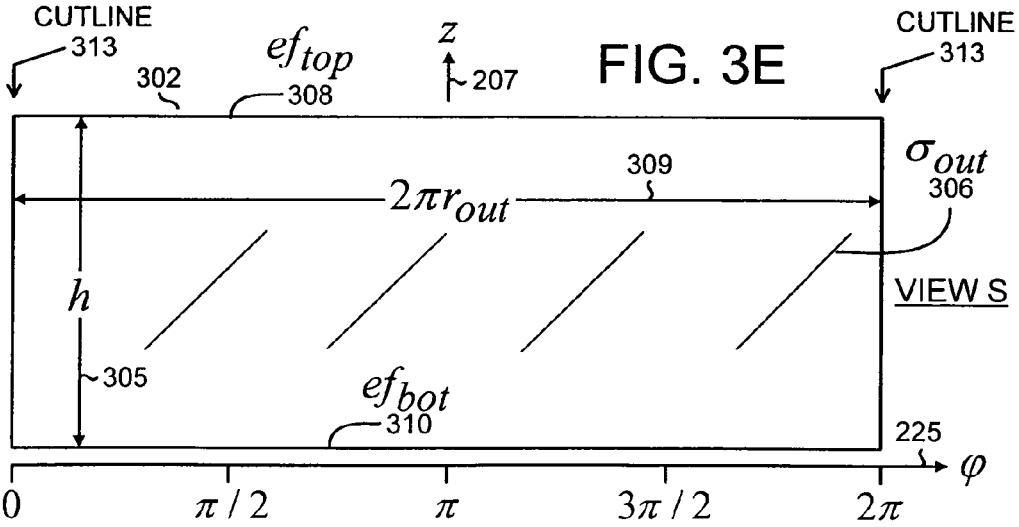

FIG. 3D shows a perspective view (View U) of the cylindrical tube 302 after it has been cut along the cutline 313 and partially unrolled. The cutline 313, shown also in FIG. 3B, lies on the x-z plane. FIG. 3E shows an azimuthal projection view (View S) of the cylindrical tube 302 after it has been completely unrolled into a flat sheet. In this view, note that the outer surface $\sigma_{out}$ 306 represents a planar surface. The dimensions are the height h 305, measured parallel to the z-axis, and the length 309 ($2\pi r_{out}$), measured orthogonal to the z-axis. Position along the length is mapped as a function of the azimuthal angle ϕ 225. In the uncut state (FIG. 3B), the azimuthal angle is measured about the z-axis, counterclockwise from the x-axis; the range of ϕ is 0≤ϕ≤2π. Note that the geometrical positions at ϕ=0 and ϕ=2π coincide when the flat sheet is rolled up into a cylindrical tube; hence, the left-hand edge and the right-hand edge in FIG. 3E are both referenced by the cutline 313.

FIG. 4A shows an azimuthal projection map (View S) of a prior-art radiator 400 configured for operation in a single frequency band. In this instance, the cylindrical tube 302 corresponds to a dielectric substrate, such as a flexible printed circuit board. The radiator 400 includes four radiating elements, referenced as radiating element 402, radiating element 404, radiating element 406, and radiating element 408. The radiating elements are all conductive strips. In this view, the radiating element 402 is shown as two segments, segment 402B on the left, and segment 402A on the right. When the dielectric substrate is rolled up into a cylindrical tube, the two segments form the continuous radiating element strip 402.

Figure 4B:
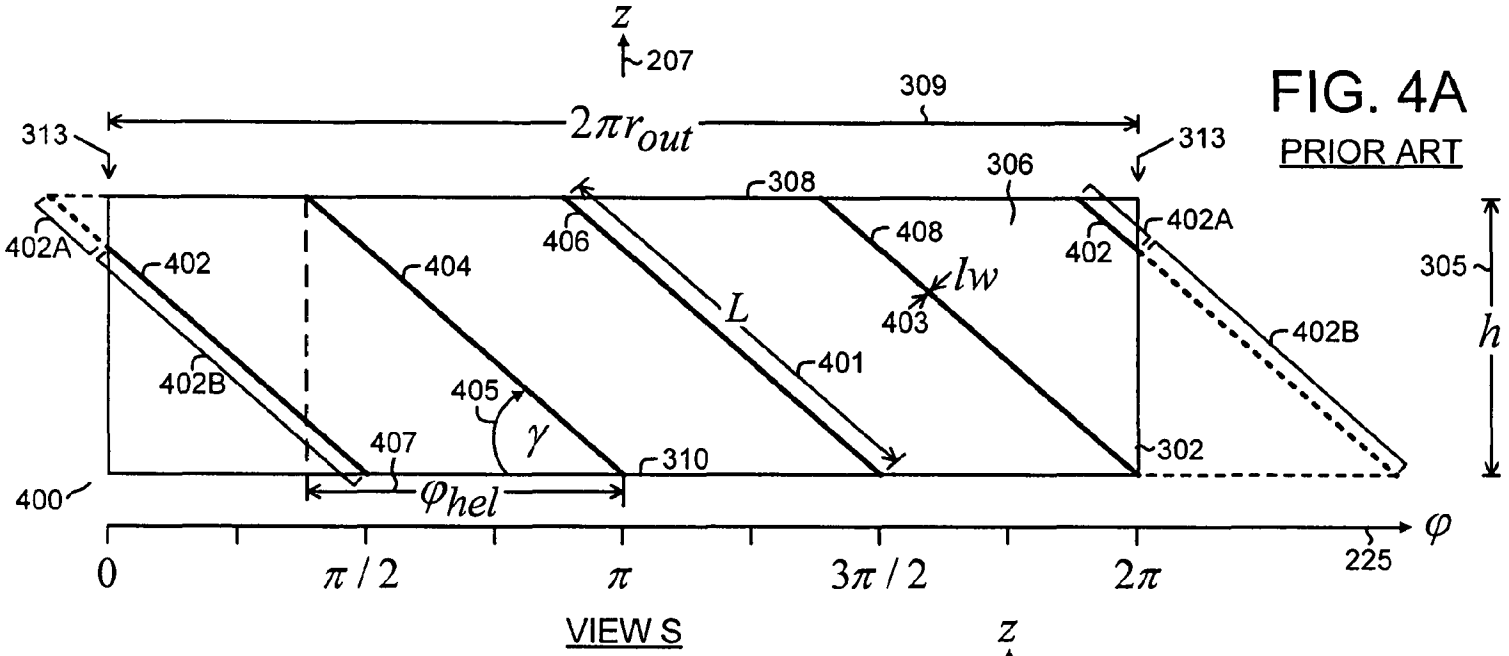
FIG. 4B PRIOR ART

In FIG. 4A, the radiating elements have the geometry of straight line segments. Each straight line segment is characterized by a length L 401, a linewidth lw 403, a winding angle γ 405, and an azimuthal span $\phi_{hel}$ 407. When the dielectric substrate is rolled into a cylindrical tube, the radiating elements have the geometry of spiral segments (turns); note that the spiral segment is a three-dimensional geometrical element. FIG. 4B shows View A of the prior-art radiator 400.

The electric current in the spiral turns has a z-th component and a $\phi$-th component. In the zenith direction ($\theta$=90°) and nadir direction ($\theta$=−90°), only the $\phi$-th component of the electric current contributes to the field in the far-field region. An actual antenna includes a radiator and a ground plane. In the radiator, the radiating elements are spiral turns, each with a length L; but a good estimate of antenna operation can be modelled by assuming that there is no ground plane and that each spiral turn has a length 2L. The current distribution along each spiral turn can be regarded as a cosine function with zeros on both ends.

Figure 4B:
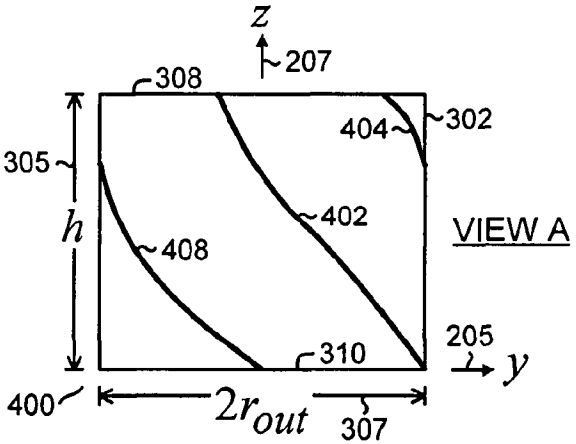
FIG. 4B PRIOR ART

The antenna pattern can be calculated from the assumptions that the electric current is continuously distributed over the cylindrical surface and that the functional dependence of the current amplitude on the angle $\phi$ is $e^{-i\phi}$. Then, the dependence of the azimuthal component of the surface current density on the coordinate z is:

$$J_\varphi(z) = \cos\left(\frac{\pi}{2L}\frac{z}{\sin\gamma}\right)e^{-i\frac{z}{a\tan(\gamma)}}, \tag{E1}$$

where:

- $J_{100}$ (z) is the azimuthal component of the surface current density as a function of z;
- $\gamma$ is the winding angle (referenced as the winding angle $\gamma$ 405 in FIG. 4); and
- a is the radius of the spiral (where a is equal to $r_{out}$ 303 in FIG. 3A and FIG. 3B).

In the far field, the antenna pattern in the direction $\theta$=−90° can be calculated from:

$$F\theta = -90° = \int_{-h}^{h} J_\varphi z e^{-ikz}\, dz, \tag{E2}$$

where h=L sin($\gamma$) and k=2$\pi$/$\lambda$. After the integration has been performed, the condition for vanishing (zero) field in the direction $\theta$=−90° can be derived from:

$$\left(k + \frac{1}{a\tan\gamma}\right)h = \frac{\pi}{2} + m\pi, \tag{E3}$$

where m=0, ±1, ±2 . . . . The case in which m=1 is of great practical interest, because it yields a radiator with the minimum possible height. Condition (E3) determines the optimum parameters of the spiral antenna that provide the best reduction of the multipath signal in the nadir direction.

Figures 5A, 5B:
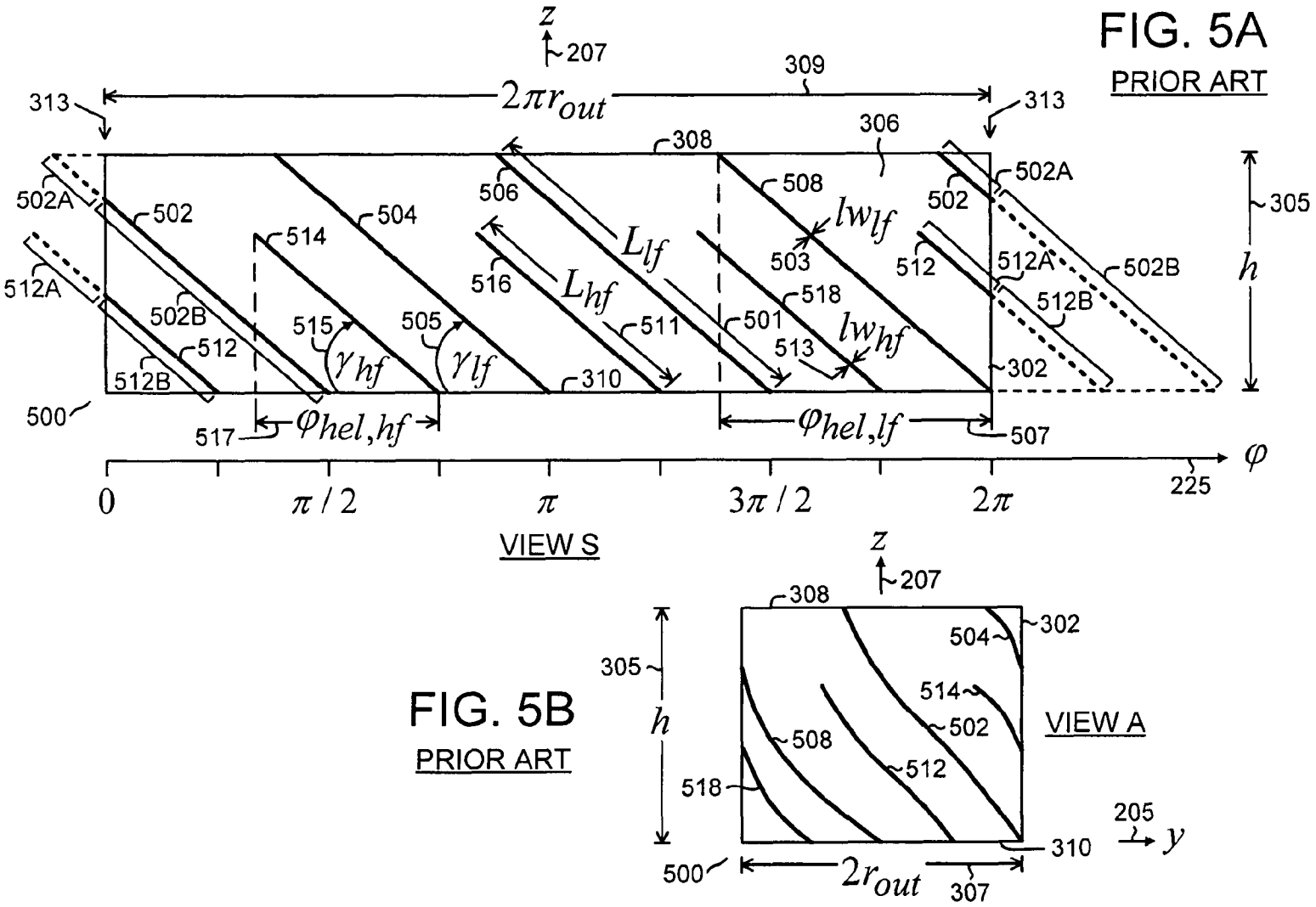
FIG. 5A PRIOR ART
FIG. 5B PRIOR ART
FIG. 5A and FIG. 5B show schematics of a prior-art dual-band radiator.

FIG. 5A shows an azimuthal projection map (View S) of a prior-art radiator 500 configured for operation in two frequency bands, referred to as the low-frequency (LF or lf) and the high-frequency (HF or hf) band. The radiator 500 includes a set of four radiating elements for the low-frequency band and a set of four radiating elements for the high-frequency band. For the low-frequency band, the four radiating elements are radiating element 502, radiating element 504, radiating element 506, and radiating element 508. In this view, the radiating element 502 is shown as two segments, segment 502B on the left, and segment 502A on the right. When the dielectric substrate is rolled up into a cylindrical tube, the two segments form the continuous radiating element 502. For the low-frequency band, each radiating element is a conductive strip, with the geometry of a straight line segment, characterized by a length $L_{lf}$ 501, a linewidth $lw_{lf}$ 503, a winding angle $\gamma_{lf}$ 505, and an azimuthal span $\phi_{hel,lf}$ 507. When the dielectric substrate is rolled into a cylindrical tube, the radiating elements have the geometry of spiral segments (turns). FIG. 5B shows View A of the prior-art radiator 500.

Similarly, for the high-frequency band, the four radiating elements are radiating element 512, radiating element 514, radiating element 516, and radiating element 518. In this view, the radiating element 512 is shown as two segments, segment 512B on the left, and segment 512A on the right. When the dielectric substrate is rolled up into a cylindrical tube, the two segments form the radiating element 512. For the high-frequency band, each radiating element is a conductive strip, with the geometry of a straight line segment, characterized by a length $L_{hf}$ 511, a linewidth $lw_{hf}$ 513, a winding angle $\gamma_{hf}$ 515, and an azimuthal span $\phi_{hel,hf}$ 517. When the dielectric substrate is rolled into a cylindrical tube, the radiating elements have the geometry of spiral segments (turns). See View A in FIG. 5B. The radiating elements for the high-frequency band are interleaved with the radiating elements for the low-frequency band.

The length L of a turn is selected on the basis of the matching condition (each radiating element can be considered as a monopole antenna):

$$L \approx \frac{\lambda}{4}, \tag{E4}$$

where $\lambda$ is the wavelength corresponding to the operational frequency; in practice, L ranges from about 0.15$\lambda$ to about 0.25$\lambda$. For GPS, for example, a representative frequency of the low-frequency band is $f_{lf}$=1227 MHz, and a representative frequency of the high-frequency band is $f_{hf}$=1575 MHz. Therefore, $$L_{lf} \approx \frac{\lambda_{lf}}{4}, \text{ and} \tag{E5}$$

$$L_{hf} \approx \frac{\lambda_{hf}}{4}, \tag{E6}$$

where $\lambda_{lf}$ is the wavelength corresponding to the frequency $f_{lf}$, and $\lambda_{hf}$ is the wavelength corresponding to the frequency $f_{hf}$.

Figure 7:
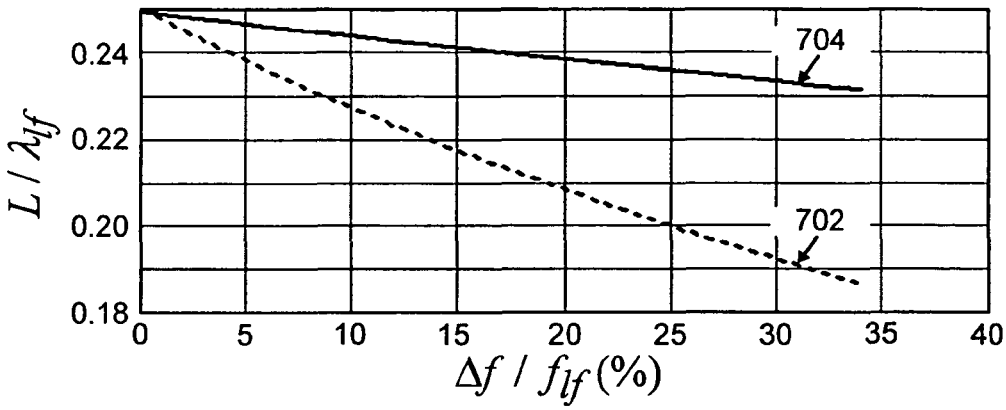
FIG. 7 shows plots of length of radiator element as a function of frequency.

The dependence of length L on frequency f according to (E4) is shown in plot 702 in FIG. 7. The horizontal axis represents the frequency as the percent deviation of the frequency from the frequency of the low-frequency band:

$$\frac{\Delta f}{f_{lf}} = \frac{f - f_{lf}}{f_{lf}} \text{(expressed in \%)}. \tag{E7}$$

The vertical axis represents the length in units of the low-frequency band wavelength: $L/\lambda_{lf}$. Therefore, for the low-frequency band, $\Delta f/f_{lf}$=0%, and $L/\lambda_{lf}$≈0.25; for the high-frequency band, $\Delta f/f_{lf}$=28%, and $L/\lambda_{lf}$≈0.19.

The dependence of length L on frequency f according to (E3) is shown as plot 704 in FIG. 7. Here the following assumptions are made: the radius $a_{lf}$ of the spiral turns for the low-frequency band is equal to the radius $a_{hf}$ of the spiral turns for the high-frequency band, and the winding angle $\gamma_{lf}$ of the spiral turns for the low-frequency band is equal to the winding angle $\gamma_{hf}$ of the spiral turns for the high-frequency band. Note that the dependence of length L on frequency f according to (E3) is weaker than the dependence of length L on frequency f according to (E4). Note that both (E3) and (E4) are simultaneously satisfied for the operational frequency of the low-frequency band ($\Delta f/f_{lf}=0\%$); however, both (E3) and (E4) are not simultaneously satisfied for other frequencies, including the operational frequency of the high-frequency band.

From plot 704, (E3) can be satisfied with values of L approximately constant as a function of frequency. From FIG. 5A, the azimuthal span can then be calculated as:

$$\varphi_{hel} = \frac{L\cos\gamma}{a}, \tag{E8}$$

where $\phi_{hel}$ corresponds to $\phi_{hel,lf}$ or $\phi_{hel,hf}$, and L corresponds to $L_{lf}$ or $L_{hf}$, respectively.

To satisfy (E3), $$\varphi_{hel} \approx \frac{3\pi}{2} - \frac{\pi}{2}\sin(\gamma). \tag{E9}$$

Under these conditions, the optimum azimuthal span $\phi_{hel}$ does not depend on frequency. Its value is about 180 deg (about half a turn) and varies in the range from about 175 deg to about 212 deg, for winding angles in the range from about 40 deg to about 75 deg. In summary, to satisfy condition (E3), $L_{hf}\approx L_{lf}$; however, to satisfy condition (E4), $L_{hf}\neq L_{lf}$.

To overcome this contradiction and guarantee good field suppression in the backward hemisphere in both frequency bands, an antenna, according to an embodiment of the invention, uses equal lengths for the low-frequency band spiral turns and the high-frequency band spiral turns: $L_{hf}\approx L_{lf}=L$ (in practice, $L_{hf}\approx L_{lf}$ to within about 10%). The winding angle $\gamma$ is selected such that condition (E3) is satisfied. For example, at a radius $a=0.05\lambda_{lf}$, and a spiral length $L=0.25\lambda_{lf}$, the winding angle is $\gamma=43°$.

The matching condition in one of the frequency bands is satisfied by selecting lengths of the spiral turns based on condition (E4), and reactive elements are added to the spiral turns of the second frequency band to satisfy the other matching condition. To minimize the loss, the spiral turn lengths should be maximized. [The radiation impedance increases as the length increases. A higher radiation impedance results in a decreased current flowing along the spiral turn, and, consequently, in a decreased loss.] Therefore, the matching condition (E4) is satisfied for the spiral turns in the low-frequency band, and capacitive elements are added to the spiral turns in the high-frequency band. For GNSS, the low-frequency band includes frequencies from about 1165 to about 1300 MHz; and the high-frequency band includes frequencies from about 1525 to about 1605 MHz. For design values, a frequency representative of the frequency band can be selected; for example, the representative frequency can be near the center of the frequency band; the wavelength corresponding to the representative frequency is the representative wavelength.

Since the condition (E4) does not need to be satisfied in the high-frequency band, the radiating elements can be configured to satisfy the condition (E3), and thereby satisfy the condition for maximum suppression of the field in the backward hemisphere. Under these conditions, the angular span $\phi_{hel}$ is given by $\phi_{hel}\approx 180°$. The resonance adjustment of the high-frequency spiral turns is implemented by selecting nominal capacitance values C connected to the high-frequency spiral turns.

Figure 6A:
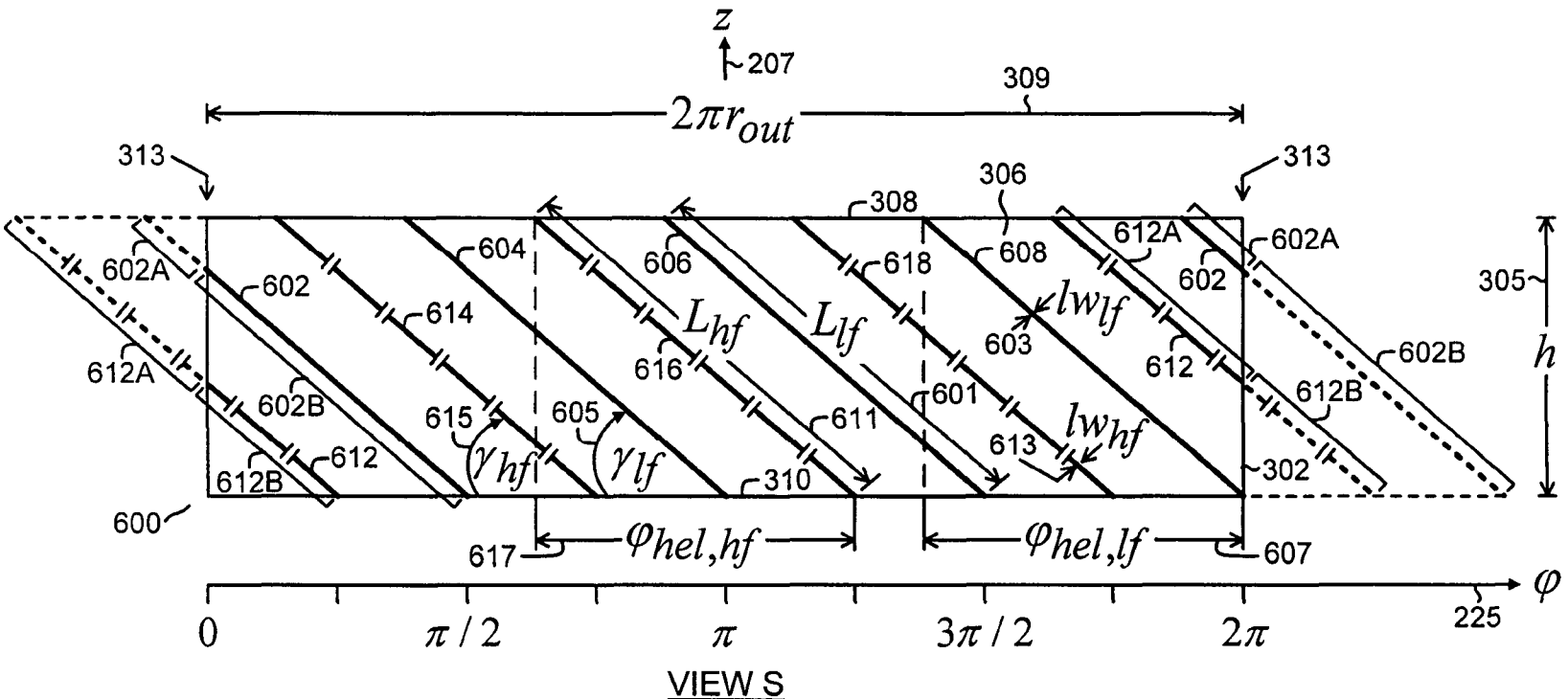
FIG. 6A-FIG. 6C show schematics of a dual-band radiator, according to an embodiment of the invention.

FIG. 6A shows an azimuthal projection map (View S) of a radiator 600, according to an embodiment of the invention, configured for operation in two frequency bands, referred to as the low-frequency (LF or lf) and the high-frequency (HF or hf) band.

Figure 6B:
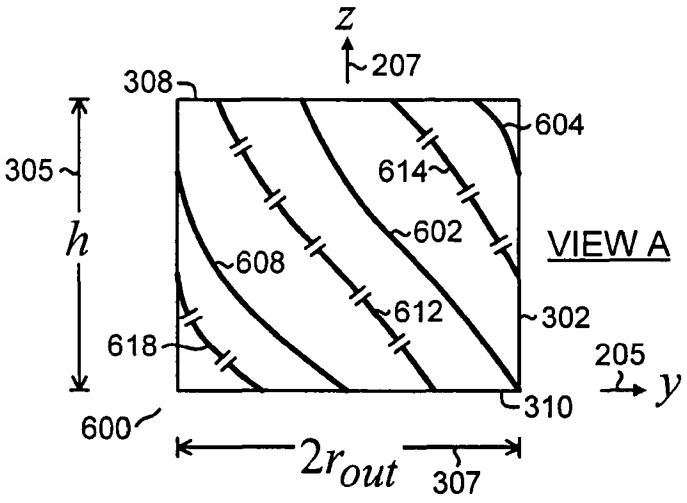

The radiator 600 includes a set of four radiating elements for the low-frequency band and a set of four radiating elements for the high-frequency band. For the low-frequency band, the radiating elements are radiating element 602, radiating element 604, radiating element 606, and radiating element 608. In this view, the radiating element 602 is shown as two segments, segment 602B on the left, and segment 602A on the right. When the dielectric substrate is rolled up into a cylindrical tube, the two segments form the continuous radiating element 602. For the low-frequency band, each radiating element is a conductive strip, with the geometry of a straight line segment, characterized by a length $L_{lf}$ 601, a linewidth $lw_{lf}$ 603, a winding angle $\gamma_{lf}$ 605, and an azimuthal span $\phi_{hel,lf}$ 607. When the dielectric substrate is rolled into a cylindrical tube, the radiating elements have the geometry of spiral segments (turns). See View A in FIG. 6B.

For the high-frequency band, the radiating elements are radiating element 612, radiating element 614, radiating element 616, and radiating element 618. In this view, the radiating element 612 is shown as two segments, segment 612B on the left, and segment 612A on the right. When the dielectric substrate is rolled up into a cylindrical tube, the two segments form the continuous radiating element 612. For the high-frequency band, each radiating element has the geometry of a linear structure, characterized by a length $L_{hf}$ 611, a winding angle $\gamma_{hf}$ 615, and an azimuthal span $\phi_{hel,hf}$ 617. In the example shown, $L_{hf}=L_{lf}=L$, $\gamma_{hf}=\gamma_{lf}=\gamma$, $\phi_{hel,hf}=\phi_{hel,lf}=\phi_{hel}$, and $a_{hf}=a_{lf}=a=r_{out}$. In other embodiments, $\gamma_{hf}\neq\gamma_{lf}$, and $\phi_{hel,hf}\neq\phi_{hel,lf}$. Further details of the linear structure are discussed below. When the dielectric substrate is rolled into a cylindrical tube, the radiating elements have the geometry of spiral segments (turns). The radiating elements for the high-frequency band are interleaved with the radiating elements for the low-frequency band. See View A in FIG. 6B.

Figure 6C:
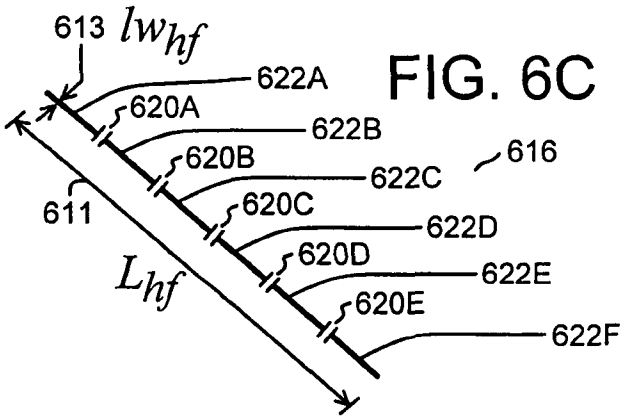

A representative radiating element in the high-frequency band is shown in FIG. 6C. The radiating element 616 comprises a chain of capacitors connected in series by conductive strips; each conductive strip has the geometry of a line segment. In this example, there are five equally spaced capacitors, referenced as capacitor 620A-capacitor 620E. The conductive strips are referenced as conductive strip 622A-conductive strip 622F. The linewidth of a conductive strip is denoted $lw_{hf}$ 613. At the frequencies of interest, a capacitor behaves as a conductor; therefore, the overall length $L_{hf}$ 611 is equal to the sum of the lengths of the conductive strips and capacitors. Each capacitor can be a lumped circuit element or a distributed circuit element (for example, a capacitor can be fabricated using standard photolithographic techniques from metal film deposited on a dielectric substrate). In an embodiment, a capacitance of about 1.8 pF is used. When a distinction in terminology needs to be made, a conductive strip in a low-frequency radiating element is referred to as a low-frequency conductive strip, and a conductive strip in a high-frequency radiating element is referred to as a high-frequency conductive strip.

In the example shown in FIG. 6C, the capacitors are equally spaced; that is the length of each conductive strip is the same. The linewidth of each conductive strip is also the same. In general, for each radiating element: there are one or more capacitors; the value of each capacitor can vary; the length of each conductive strip can vary; the linewidth of each conductive strip can vary; and the linewidth can vary along a conductive strip [in particular, in an embodiment, the linewidth increases from one end (pointing towards the ground plane) to the other end (the free end, pointing away from the ground plane); see discussion below]. In general, the configurations of all the radiating elements are substantially the same. In an embodiment, a capacitor can be placed at the end of the radiating element connected to the ground plane (see discussion below).

Figure 8:
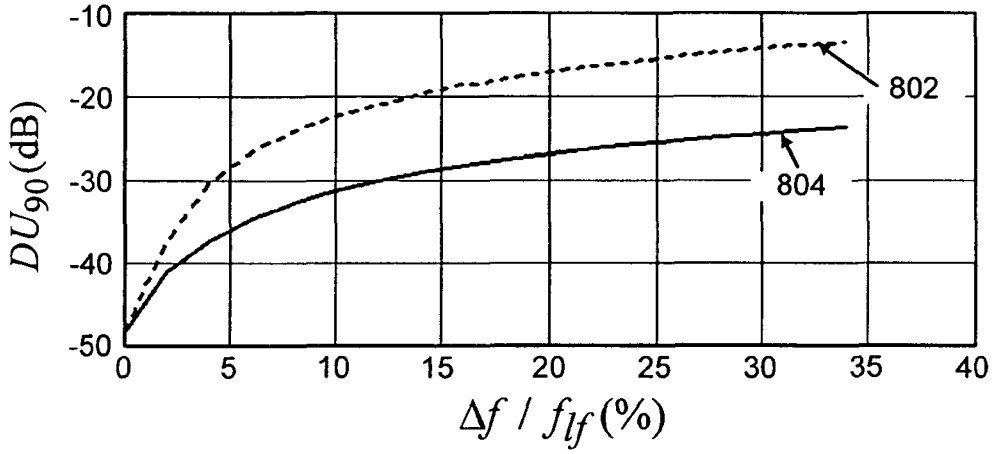
FIG. 8 shows plots of down/up ratio as a function of frequency.

FIG. 8 shows plots of values of the down/up ratio as a function of frequency. The horizontal axis represents the frequency as the percent deviation of the frequency from the frequency of the low-frequency band; see (E7). The vertical axis represents values of $DU_{90}$ (dB), the down/up ratio for $\theta=90°$. Plot 804 shows the results for $L_{hf}=L_{lf}=L=\lambda_{lf}/4$. Plot 802 shows the results in which the length of spiral turns is determined by (E4) (that is, for a prior-art radiator as shown in FIG. 5A and FIG. 5B). As discussed before, a frequency deviation of $\Delta f/f_{lf}=28\%$ corresponds to the high-frequency GPS L2 band (when the low-frequency band corresponds to the GPS L1 band). Comparing plot 802 and plot 804, for $\Delta f/f_{lf}=28\%$, the value of $DU_{90}$ in plot 804 is 10 dB less than the value of $DU_{90}$ in plot 802.

Figure 9B:
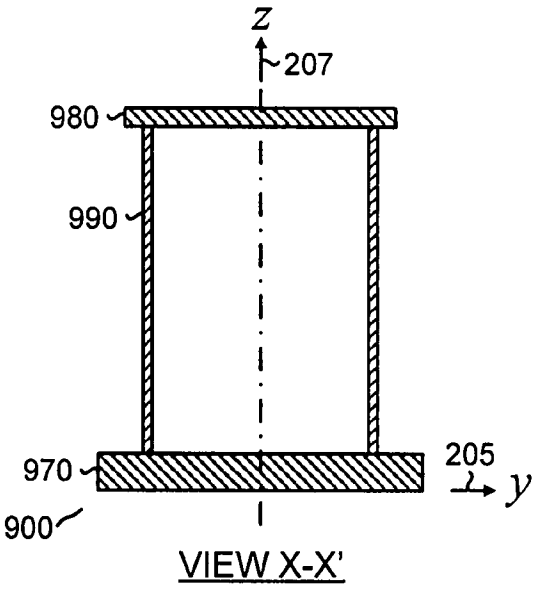
FIG. 9A-FIG. 9J show schematics of a dual-band antenna, according to an embodiment of the invention.
Figure 9A:
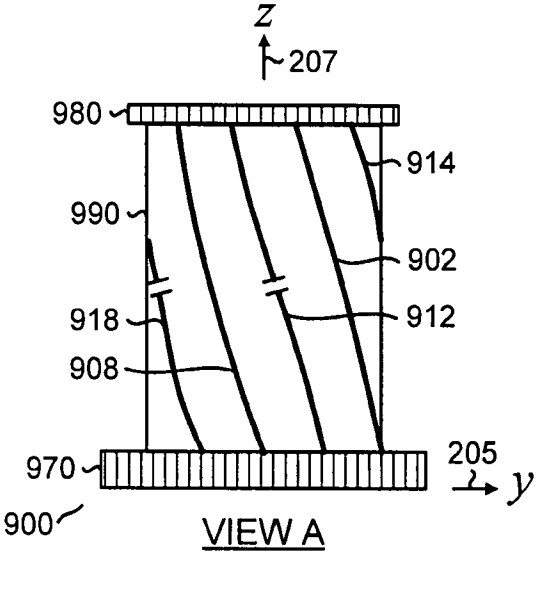

FIG. 9A-FIG. 9J show an embodiment of a dual-band antenna with reduced multipath reception; it is configured to receive circularly-polarized radiation, as used in GNSS applications. FIG. 9A shows View A of the dual-band antenna 900; FIG. 9B shows a corresponding cross-sectional view, View X-X', sliced along the y-z plane. The dual-band antenna 900 includes the ground plane 980, the radiator 990, and the base 970.

Figure 9C:
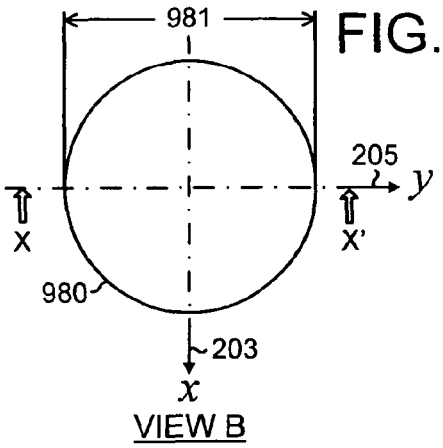
Figure 9D:
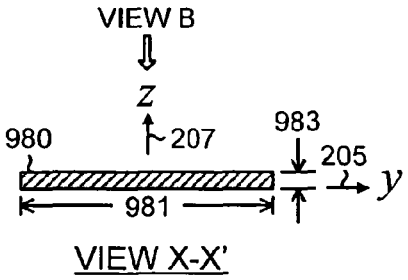
Figure 9E:
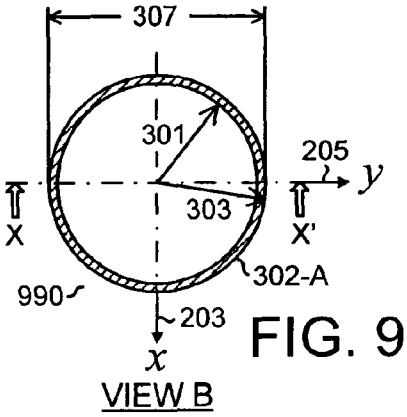
Figure 9F:
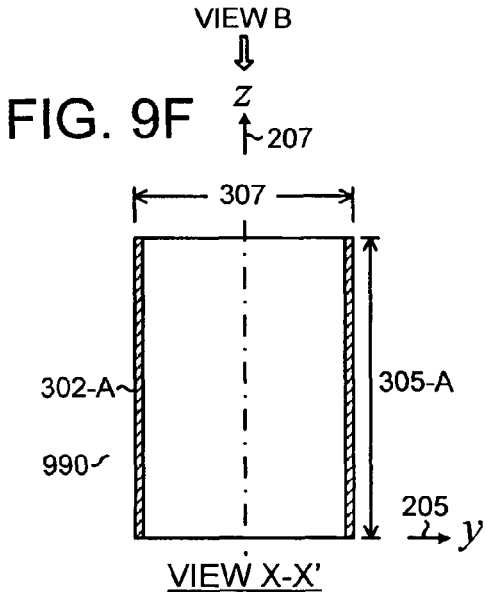
Figure 9G:
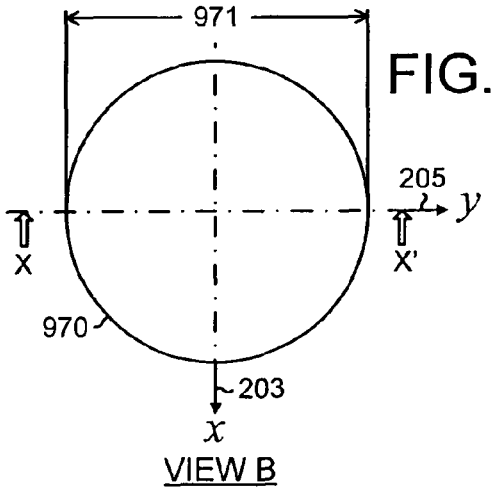
Figure 9H:
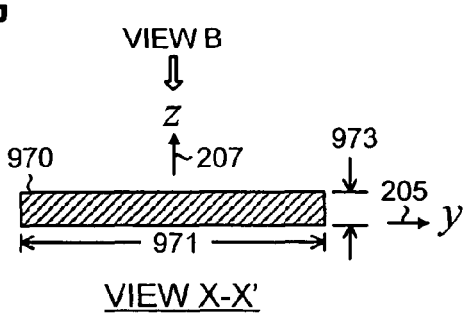

Geometrical details of the ground plane 980 are shown in FIG. 9C (View B) and FIG. 9D (View X-X'). The ground plane 980 is a conductive disc with a diameter 981 and a height (thickness) 983; the ground plane 980 can be fabricated, for example, from a conductive metal such as copper or aluminum. Geometrical details of the base 970 are shown in FIG. 9G (View B) and FIG. 9H (View X-X'). The base 980 is a dielectric disc with a diameter 971 and a height (thickness) 973; the base can be fabricated, for example, from a dielectric such as plastic. Geometrical details of the radiator 990 are shown in FIG. 9E (View B) and FIG. 9F (View X-X'). The radiator 990 includes a dielectric cylindrical tube 302-A with an inside radius 301, an outside radius 303, and a height 305-A; the outside diameter 307 is two times the outside radius 303. The outside diameter 981 of the ground plane 980 and the outside diameter 971 of the base 970 are typically greater than or equal to the outside diameter 307 of the radiator 990. The ground plane 980 and the base 970 can have other specified geometries, such as a square; the geometries of the ground plane 980 and the base 970 do not need to be the same.

Figure 9I:
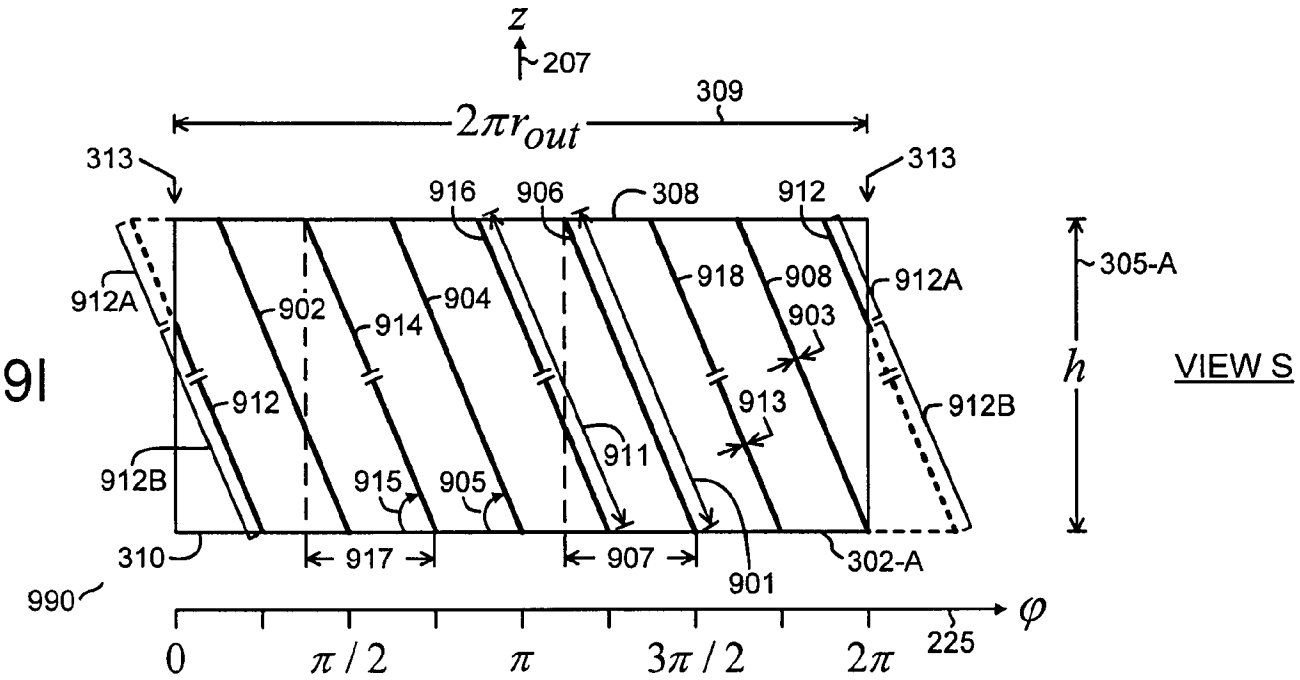

FIG. 9I shows an azimuthal projection map (View S) of the radiator 990. The radiator 990 includes a set of four radiating elements for the low-frequency band and a set of four radiating elements for the high-frequency band. For the low-frequency band, the radiating elements are radiating element 902, radiating element 904, radiating element 906, and radiating element 908. For the low-frequency band, each radiating element is a conductive strip, with the geometry of a straight line segment, characterized by a length $L_{lf}$ 901, a linewidth $lw_{lf}$ 903, a winding angle $\gamma_{lf}$ 905, and an azimuthal span $\phi_{hel,lf}$ 907. When the dielectric substrate is rolled into a cylindrical tube, the radiating elements have the geometry of spiral segments (turns). See View A in FIG. 9A.

For the high-frequency band, the radiating elements are radiating element 912, radiating element 914, radiating element 916, and radiating element 918. In this view, the radiating element 912 is shown as two segments, segment 912B on the left, and segment 912A on the right. When the dielectric substrate is rolled up into a cylindrical tube, the two segments form the continuous radiating element 912. For the high-frequency band, each radiating element has the geometry of a linear structure, characterized by a length $L_{hf}$ 911, a winding angle $\gamma_{hf}$ 915, and an azimuthal span $\phi_{hel,hf}$ 917. In the example shown, $L_{hf}=L_{lf}=\gamma_{hf}=\gamma_{lf}=\gamma$, $\phi_{hel,hf}=\phi_{hel,lf}=\phi_{hel}$, and $a_{hf}=a_{lf}=a=r_{out}$. Further details of the linear structure are discussed below. When the dielectric substrate is rolled into a cylindrical tube, the radiating elements have the geometry of spiral segments (turns). The radiating elements for the high-frequency band are interleaved with the radiating elements for the low-frequency band. See View A in FIG. 9A.

Figure 9J:
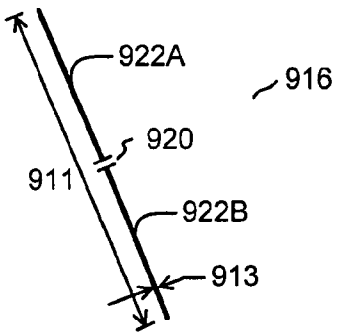

FIG. 9J shows details of a representative radiating element in the high-frequency band. The radiating element 916 includes the conductive strip 922A, the capacitor 920, and the conductive strip 922B in series. Each conductive strip has the geometry of a line segment with a linewidth 913. The length of the capacitor is considered to be negligible; the sum of the lengths of the two conductive strips add up to the total length 911.

Refer back to FIG. 9A. Each radiating element in the low-frequency band and each radiating element in the high-frequency band has a first end and a second end. One end of a radiating element (the first end) is electrically connected to the ground plane 980; for example, the radiating elements can be electrically connected to the ground plane by solder joints or other electrical connections. The radiator 990 is attached to the base 970 with adhesive or with mechanical fasteners. The other end of a radiating element (the second end) is not electrically connected to another component and is also referred to as the free end.

Figure 10B:
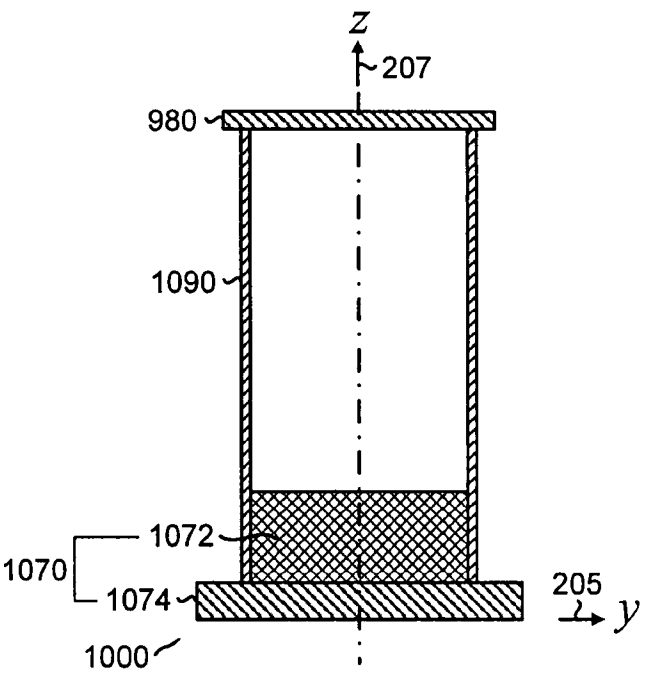
Figure 10A:
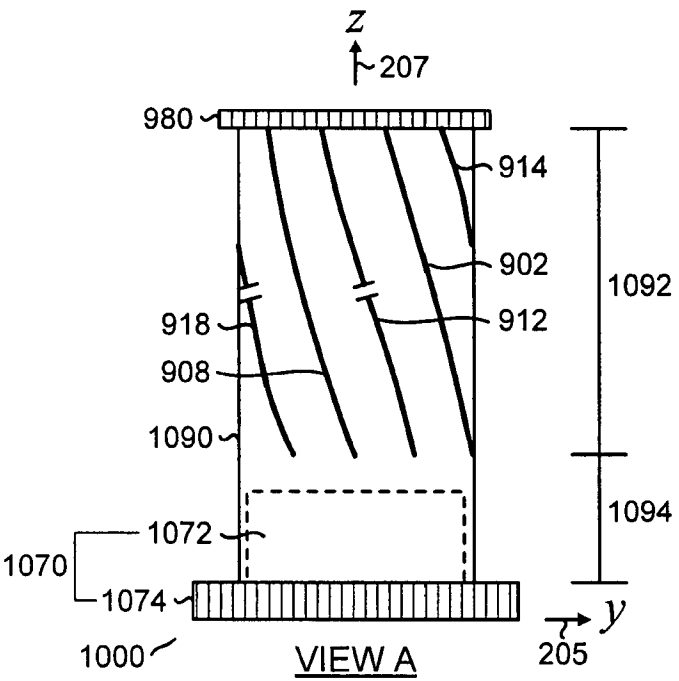

FIG. 10A-FIG. 10G show another embodiment of a dual-band antenna with reduced multipath reception. The dual-band antenna 1000 is similar to the dual-band antenna 900, but with a different geometrical configuration for the radiator and the base; the ground plane is the same. FIG. 10A shows View A of the dual-band antenna 1000; FIG. 10B shows a corresponding cross-sectional view, View X-X', sliced along the y-z plane. The dual-band antenna 1000 includes the ground plane 980, the radiator 1090, and the base 1070.

Geometrical details of the base 1070 are shown in FIG. 10C (View B) and FIG. 10D (View X-X'). The base 1070 is a dielectric plug fabricated, for example, from a dielectric such as plastic. The base 1070 includes two cylindrical sections, which can be fabricated as a single piece or fabricated as two pieces and attached together. The cylindrical section 1074 has a diameter 1073 and a height 1075; the cylindrical section 1072 has a diameter 1071 and a height 1077. Geometrical details of the radiator 1090 are shown in FIG. 10E (View B) and FIG. 10F (View X-X'). The radiator 1090 includes a dielectric cylindrical tube 302-B with an inside radius 301, an outside radius 303, and a height 305-B;

the outside diameter 307 is two times the outside radius 303, and the inside diameter 315 is two times the inside radius 301.

The cylindrical section 1072 of the base 1070 is inserted into the bottom of the radiator 1090 (see FIG. 10A and FIG. 10B). The diameter 1071 of the cylindrical section 1072 is specified such that the cylindrical section 1072 has a snug fit inside the radiator 1090. When the radiator 1090 has a thin, flexible wall, the cylindrical section 1072 provides additional structural support. The diameter 1073 of the cylindrical section 1074 is greater than or equal to the outside diameter 307 of the radiator 1090. The radiator 1090 can be attached to the base 1070 with adhesive or with mechanical fasteners. [Note: The base 1070 can also be used with the radiator 990 shown in FIG. 9A and FIG. 9B.]

Figure 10G:
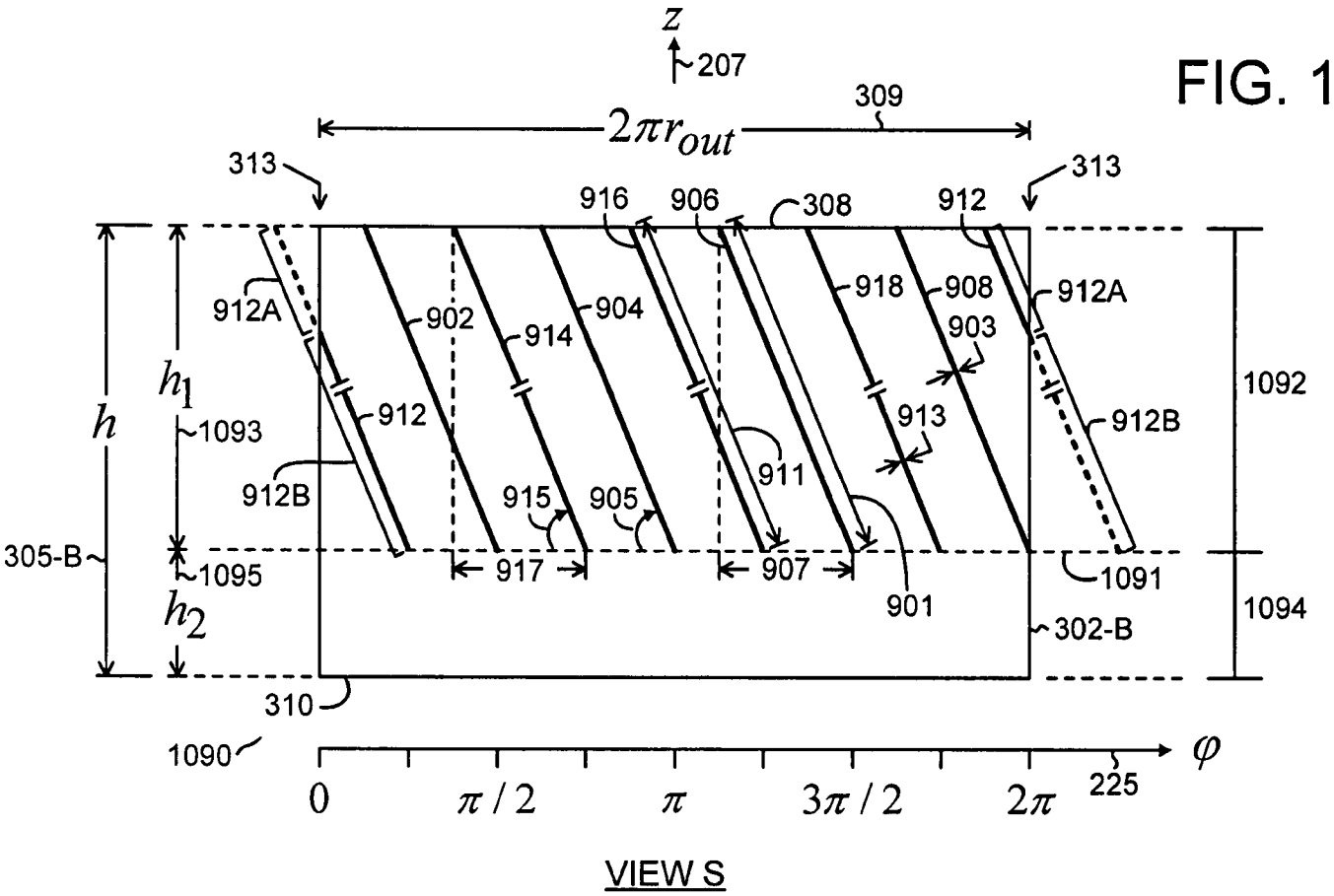

FIG. 10G shows an azimuthal projection map (View S) of the radiator 1090. The radiator 1090 has a top section 1092 and a bottom section 1094 (also shown in FIG. 10A) separated by the boundary 1091. The top section 1092 is similar to the radiator 990 (see FIG. 9I). The height h 305-B of the cylindrical tube 302-B in FIG. 10G is greater than the height h 305-A of the cylindrical tube 302-A in FIG. 9I. The height $h_1$ 1093 of the top section 1092 is equal to the height h 305-A in FIG. 9I. The bottom section 1094, has a bare dielectric surface (no radiating elements). Refer back to FIG. 10A. The first end of each radiating element (in the low-frequency band and in the high-frequency band) is electrically connected to the ground plane 980; for example, the radiating elements can be electrically connected to the ground plane by solder joints or other electrical connections. The second end of each radiating element is free.

The radiating elements are excited with an excitation circuit. The excitation circuit can be fabricated separately from the ground plane for the radiator (such as the ground plane 980 in FIG. 9A and FIG. 10A). Since an excitation circuit typically also requires a ground plane, however, in an advantageous embodiment, a ground plane and an excitation circuit are fabricated as an integrated unit. A single ground plane can serve as both the ground plane for the radiator and the ground plane for the excitation circuit.

Figure 11A:
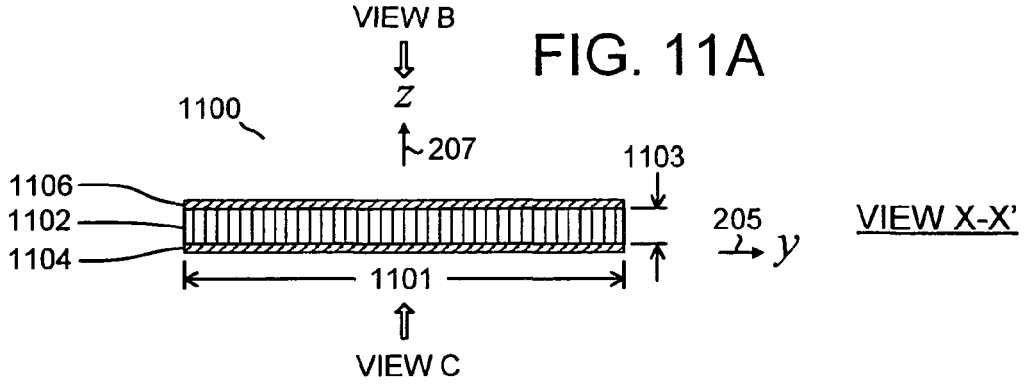
FIG. 11A-FIG. 11D show schematics of an integrated ground plane and excitation circuit, according to an embodiment of the invention.

FIG. 11A-FIG. 11D show an integrated ground plane and excitation circuit 1100, according to an embodiment of the invention. FIG. 11A shows a cross-sectional view (View X-X'). The integrated ground plane and excitation circuit 1100 includes a printed circuit board (PCB) 1102, with a diameter 1101 and a thickness 1103. There is a metallization layer 1104 on the bottom side of the PCB 1102 and a metallization layer 1106 on the top side of the PCB 1102.

Figure 11B:
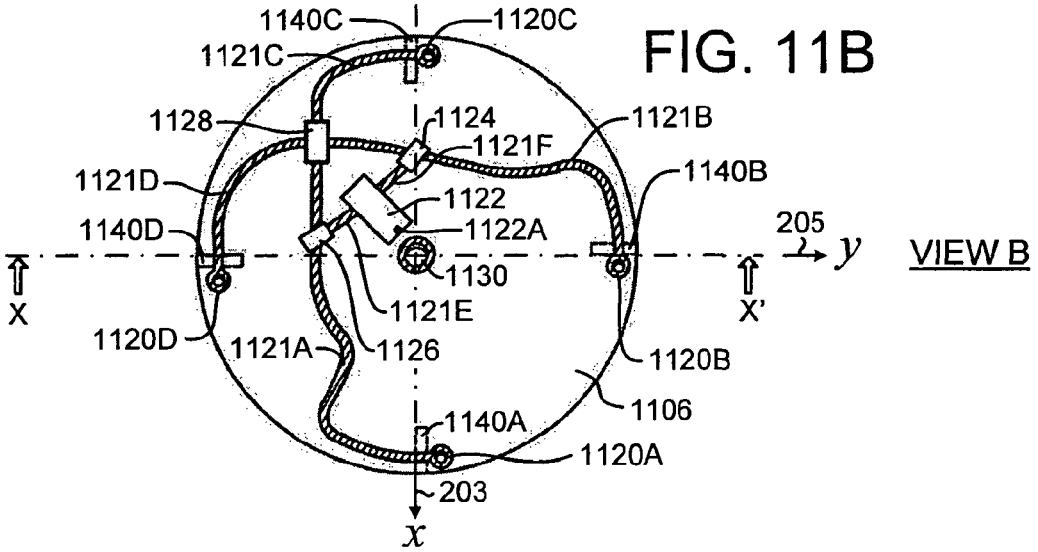
Figure 11C:
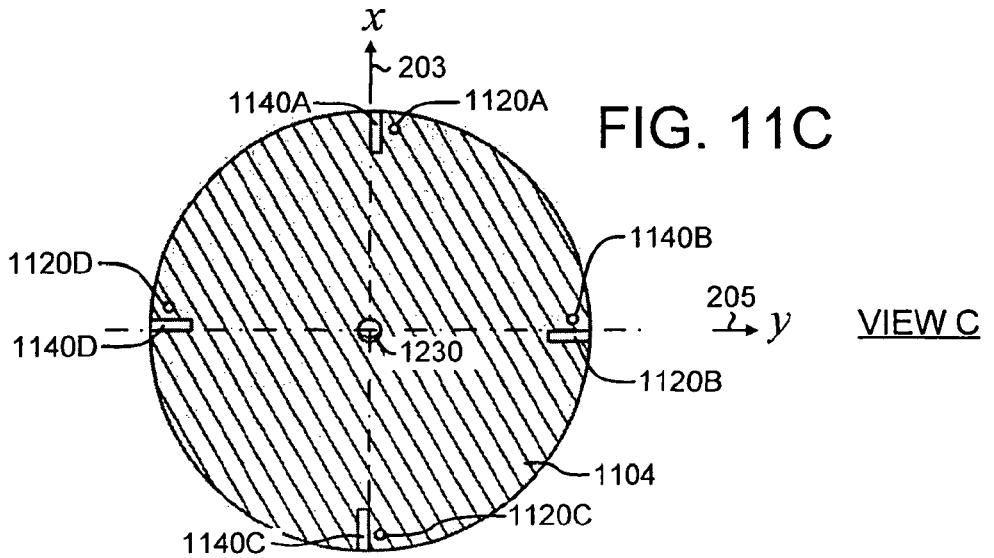

Refer to FIG. 11C, which shows View C, sighted along the +z-axis, of the bottom metallization layer 1104. With the exception of a few features, the bottom side of the PCB 1102 is completely covered with the bottom metallization layer 1104, which serves as a ground plane for both the radiator and the excitation circuit. In the bottom metallization layer 1104, there are four slots, referenced as slot 1140A-slot 1140D, from which metallization has been removed. The four slots are configured in a azimuthally-spaced sequence, equally spaced at 90 deg, and are offset from the centerlines such that the spacing between adjacent slots is maximized. Adjacent to each slot is a corresponding metallized via, which electrically connects the slot to the termination of a microstrip line on the excitation circuit (described below). Metallized via 1120A—metallized via 1120D correspond to slot 1140A-slot 1140D, respectively. The spacing between a slot and its corresponding adjacent metallized via can be varied to tune the operating characteristics of the antenna.

Figure 11D:
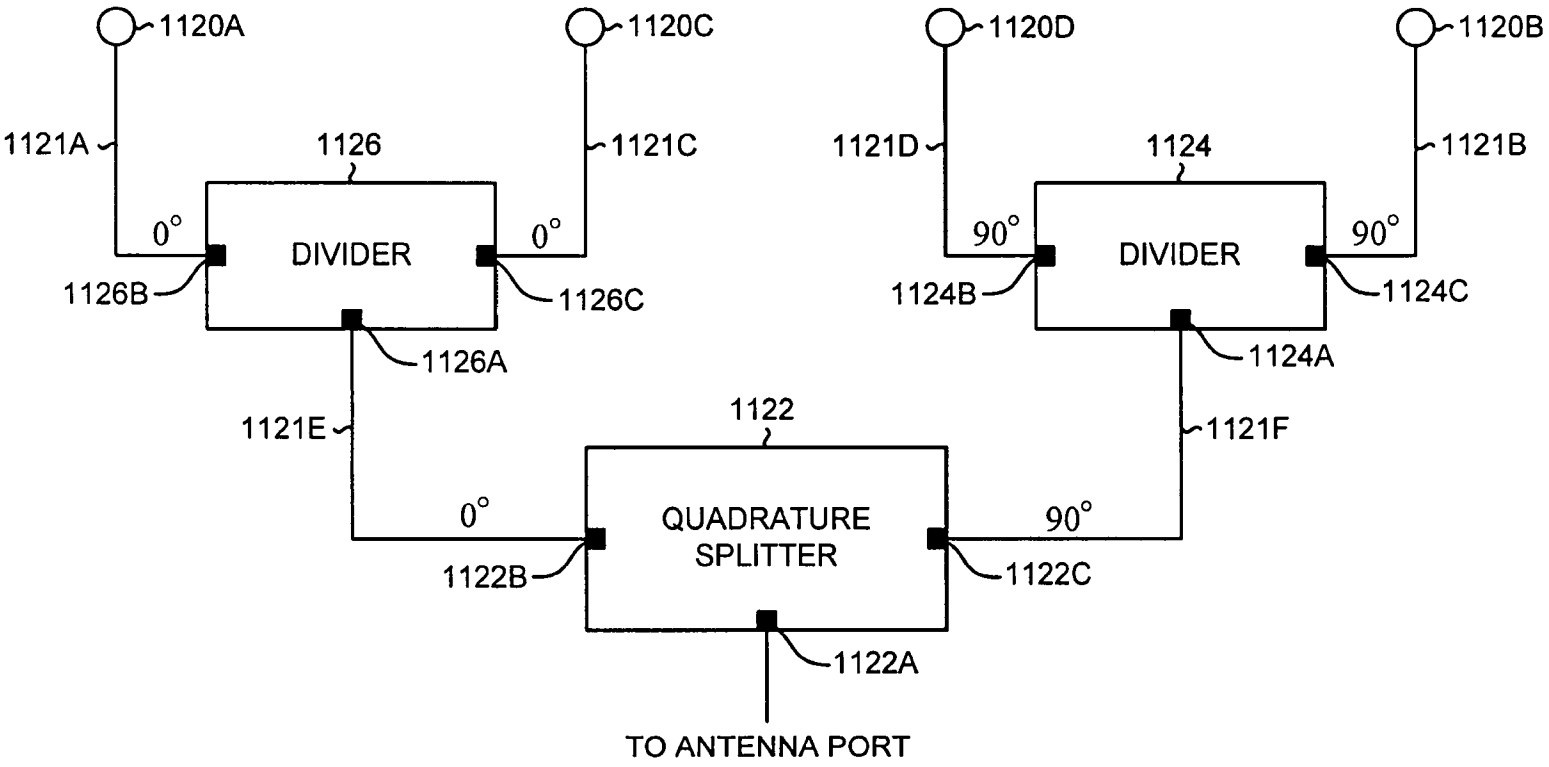

Refer to FIG. 11B and FIG. 11D; the description below refers to FIG. 11B and FIG. 11D in parallel. An excitation circuit is fabricated on the top metallization layer 1106. FIG. 11B shows a physical schematic; FIG. 11D shows an electrical schematic. The top metallization layer 1106 includes features such as microstrip lines and metallized vias; otherwise, most of the top side of the PCB 1102 is free of metallization.

The excitation circuit includes a quadrature splitter 1122, a balanced divider 1124, and a balanced divider 1126. The center conductor of a coax cable (not shown) is fed through the hole 1130 and electrically connected to the input port 1122A of the quadrature splitter 1122. The other end of the coax cable terminates in an antenna port (not shown). The antenna port is coupled to the input port of a receiver (receive mode) or to the output port of a transmitter (transmit mode).

The quadrature splitter 1122 is an equal amplitude splitter; that is, the signal level at the output port 1122B and the signal level at the output port 1122C are each nominally −3 dB down from the signal level at the input port 1122A, and the signal at the output port 1122C has a 90 deg phase shift with respect to the signal at the output port 1122B.

The microstrip line 1121E connects the output port 1122B of the quadrature splitter 1122 to the input port 1126A of the divider 1126. The divider 1126 is an equal amplitude splitter; that is, the signal level at the output port 1126B and the signal level at the output port 1126C are each nominally −3 dB down from the signal level at the input port 1126A, and the signal at the output port 1126C is in-phase with the signal at the output port 1126B. The microstrip line 1121A electrically connects the output port 1126B to the metallized via 1120A, and the microstrip line 1121C electrically connects the output port 1126C to the metallized via 1120C.

Similarly, the microstrip line 1121F connects the output port 1122C of the quadrature splitter 1122 to the input port 1124A of the divider 1124. The divider 1124 is an equal amplitude splitter; that is, the signal level at the output port 1124B and the signal level at the output port 1124C are each nominally −3 dB down from the signal level at the input port 1124A, and the signal at the output port 1124C is in-phase with the signal at the output port 1124B. The microstrip line 1121D electrically connects the output port 1124B to the metallized via 1120D, and the microstrip line 1121B electrically connects the output port 1124C to the metallized via 1120B. In FIG. 11B, electrical element 1128 is a dielectric spacer that prevents electrical contact between the microstrip line 1121C and the microstrip line 1121D as they cross over each other.

Refer to FIG. 11C. As described above, the metallized vias are electrically connected to the ground plane fabricated on the bottom metallization layer 1104. The excitation circuit then provides equal amplitude excitation of the four slots. The excitation signal at slot 1140A is in-phase with the excitation signal at slot 1140C; the excitation signal at slot 1140B is in-phase with the excitation signal at slot 1140D; and the excitation signal at slot 1140B and the excitation signal at slot 1140D are phase shifted by 90 deg from the excitation signal at slot 1140A and the excitation signal at slot 1140C. The excitation circuit, therefore, excites circularly-polarized radiation, as required for GNSS.

FIG. 12A shows an electrical connectivity diagram between the bottom metallization layer 1104 and sets of radiating elements (the sets of radiating elements are physically configured on the surface of a cylindrical tube as in FIG. 9A). For the low-frequency band, the radiating elements are radiating element 1202, radiating element 1204, radiating element 1206, and radiating element 1208, which are electrically connected to the metallization layer 1104 by solder joint 1232, solder joint 1234, solder joint 1236, and solder joint 1238, respectively. Each radiating element is a conductive strip.

For the high-frequency band, the radiating elements are radiating element 1212, radiating element 1214, radiating element 1216, and radiating element 1218, which are electrically connected to the metallization layer 1104 by solder joint 1242, solder joint 1244, solder joint 1246, and solder joint 1248, respectively. The solder joints are adjacent to the slots and are spaced the maximum distance apart. FIG. 12B shows details of a representative radiating element in the high-frequency band. The radiating element 1212 includes a series of conductive strips and capacitors. In this example, there are two capacitors, referenced as capacitor 1220A and capacitor 1220B, and three conductive strips, referenced as conductive strip 122A, conductive strip 1222B, and conductive strip 1222C.

The radiating elements in both the low-frequency band and in the high-frequency band are excited by the slots. The positions of the radiating elements relative to the slots are adjusted to tune the input impedances. In an embodiment, the high-frequency radiating elements are adjacent to the slots, and the low-frequency radiating elements are further away from the slots.

Figure 13C:
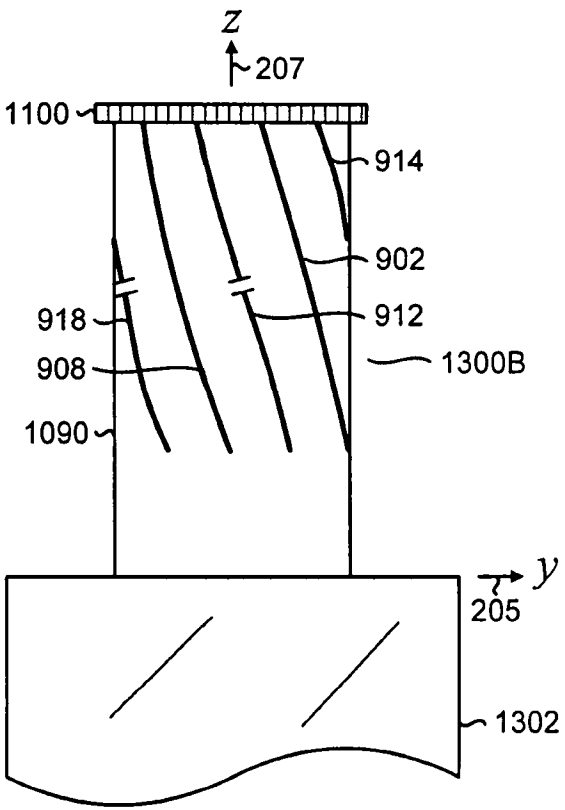
FIG. 13A-FIG. 13C show different options for orienting and mounting a dual-band antenna.
Figure 13B:
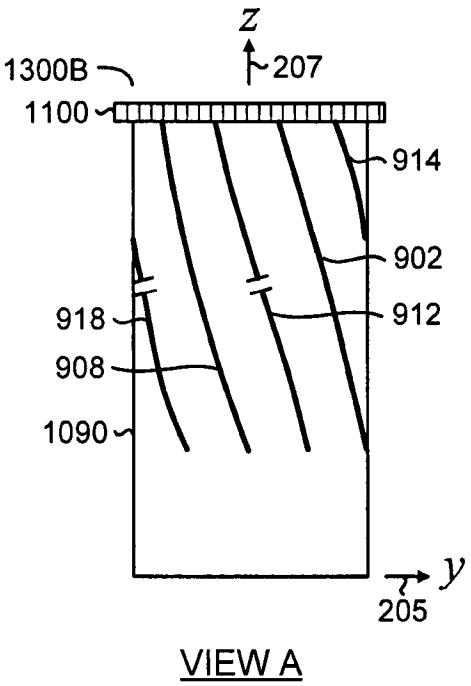
Figure 13A:
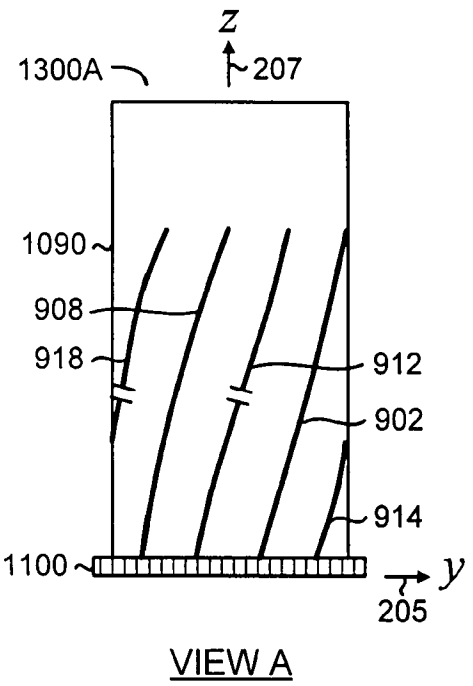

In FIG. 13A, the antenna 1300A is configured with the radiator 1090 mounted above the integrated ground plane and excitation circuit 1100. In FIG. 13B, the antenna 1300B is configured with the radiator 1090 mounted below the integrated ground plane and excitation circuit 1100. The antenna 1300B is advantageous for integrating the antenna with a GNSS receiver 1302, as shown in FIG. 13C, to maintain maximum separation between the integrated ground plane and excitation circuit 1100 and the metal housing of the GNSS receiver 1302.

Figure 14A:
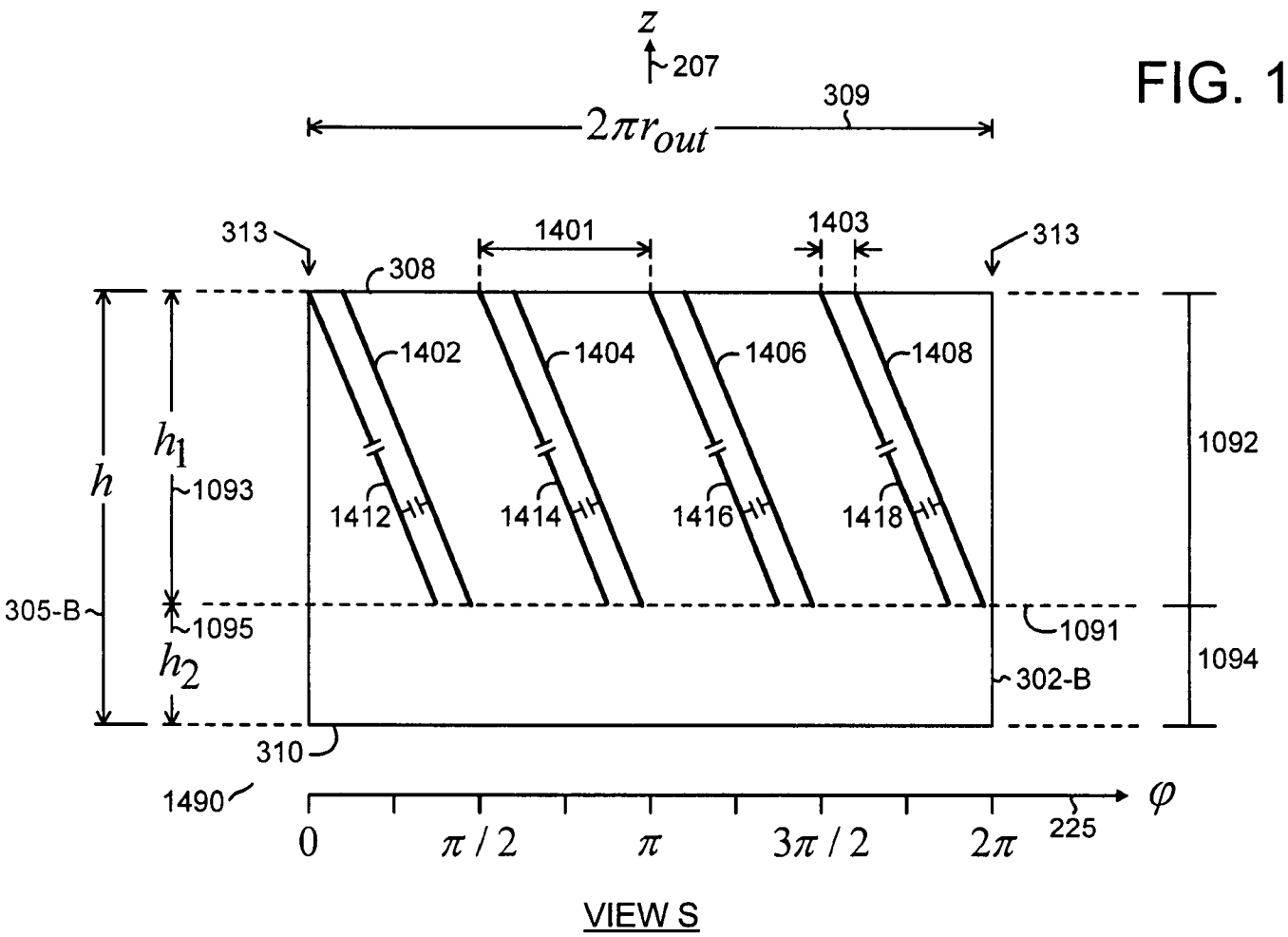
FIG. 14A-FIG. 14C show schematics of a dual-band radiator, according to an embodiment of the invention.

To improve operating characteristics, capacitive coupling can be introduced between adjacent high-frequency (HF) and low-frequency (LF) radiating elements. FIG. 14A shows the radiator 1490, which is similar to the radiator 1090 previously shown in FIG. 10G. For the low-frequency band, the radiating elements are radiating element 1402, radiating element 1404, radiating element 1406, and radiating element 1408. For the high-frequency band, the radiating elements are radiating element 1412, radiating element 1414, radiating element 1416, and radiating element 1418. The azimuthal spacing between two consecutive high-frequency radiating elements is $(\Delta\phi)_1$ 1401 (which is equal to $\pi/2$ for four azimuthally-symmetrical high-frequency radiating elements). The azimuthal spacing between a high-frequency radiating element and a low-frequency radiating element is $(\Delta\phi)_2$ 1403. This value is a specified design value; in an embodiment, this value ranges from about 5 deg to about 45 deg.

Figure 14C:
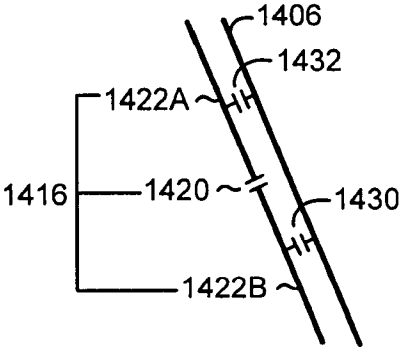
Figure 14B:
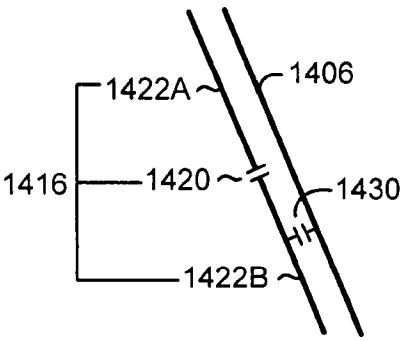

FIG. 14B shows details of a representative pair of HF and LF radiating elements. The HF radiating element 1416 includes the conductive strip 1422A, the capacitor 1420, and the conductive strip 1422B connected in series. The LF radiating element is a conductive strip 1406. The coupling capacitor 1430 is electrically connected across the HF radiating element 1416 and the LF radiating element 1406. The coupling capacitor 1430 can be positioned at specified positions along the lengths of the HF radiating element 1416 and the LF radiating element 1406. In general, one or more coupling capacitors can be electrically connected across the HF radiating element and the LF radiating element. For example, in FIG. 14C, there are two such coupling capacitors: coupling capacitor 1430 and coupling capacitor 1432.

As discussed above, in general, a HF radiating element can include one or more conductive strips and one or more capacitors in series. In general, to improve impedance matching, one or more coupling capacitors can be electrically connected across a HF radiating element and its corresponding adjacent LF radiating element. The coupling capacitors can be positioned at specified positions along the lengths of the HF radiating element and the LF radiating element. Where needed to distinguish terminology, a capacitor that is a component of a HF radiating element is referred to as a HF capacitor, and a capacitor that couples a HF radiating element and a LF radiating element is referred to as a coupling capacitor.

Figure 15A:
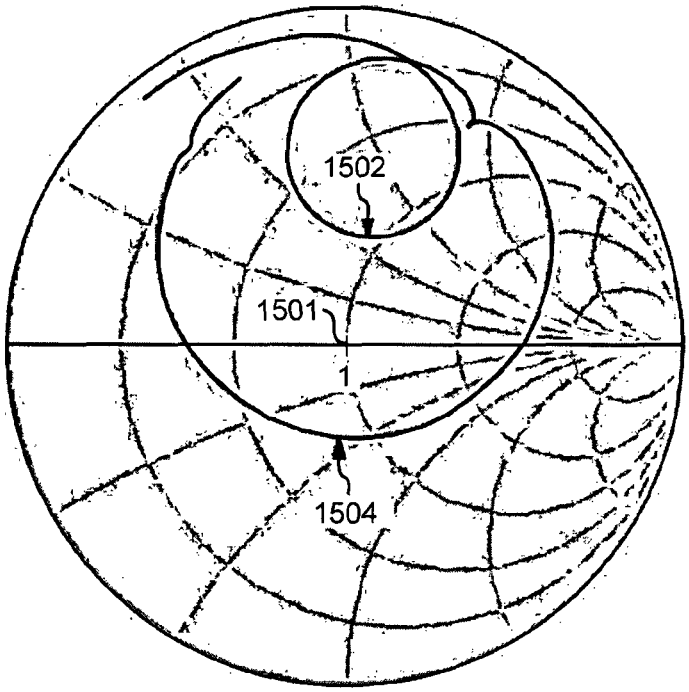
FIG. 15A and FIG. 15B show Smith Charts comparing impedance matching for different dual-band antennas.
Figure 15B:
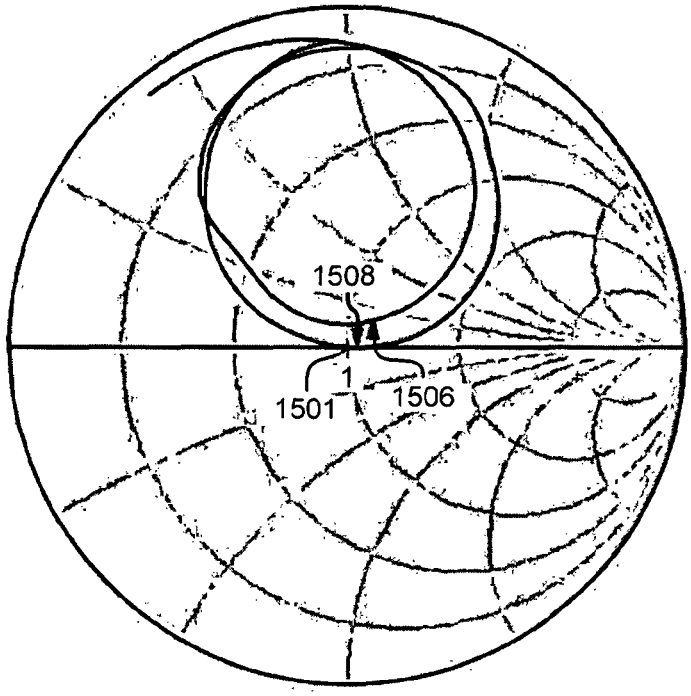

FIG. 15A shows the normalized impedance Smith Chart for the configuration in which there is no added capacitive coupling between the HF and the LF radiating elements. Similarly, FIG. 15B shows the normalized impedance Smith Chart for the configuration in which there is added capacitive coupling between the HF and the LF radiating elements. In an embodiment, the added coupling capacitance is about 0.2 pF. In both charts, indicator 1501 marks the desired normalized impedance of 1. In FIG. 15A, indicator 1502 marks the normalized impedance for the LF band, and indicator 1504 marks the normalized impedance for the HF band. In FIG. 15B, indicator 1506 marks the normalized impedance for the LF band, and indicator 1508 marks the normalized impedance for the HF band. By comparing FIGS. 15A and 15B, it is clear that the configuration in which there is added capacitive coupling between the HF and the LF radiating elements provides better impedance matching for both the HF and the LF bands.

Figure 16A:
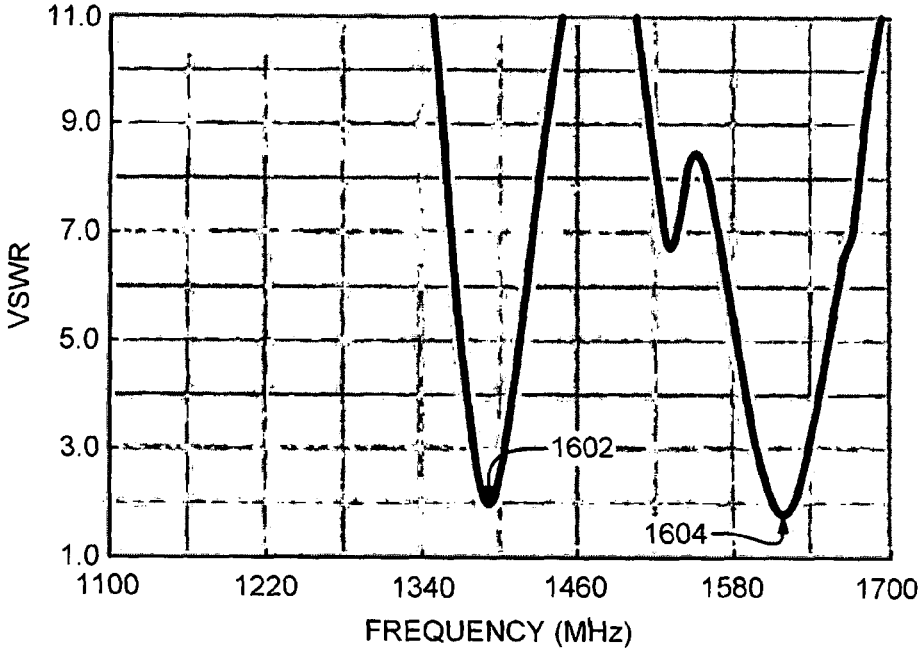
FIG. 16A and FIG. 16B show plots comparing voltage standing-wave ratio as a function of frequency for different dual-band antennas.
Figure 16B:
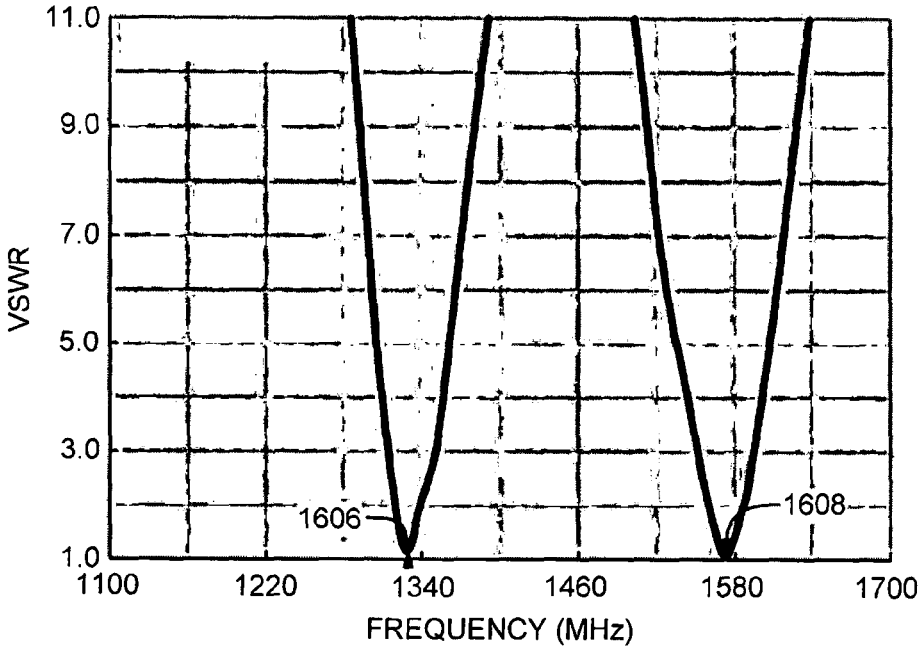

FIG. 16A shows a plot of voltage standing wave ration (VSWR) as a function of frequency for the antenna configuration without added capacitive coupling. Indicator 1602 marks the value of VSWR for the LF band (1.39 GHz, 1.97), and indicator 1604 marks the value of VSWR for the HF band (1.62 GHz, 1.76). Similarly, FIG. 16B shows a plot of voltage standing wave ratio (VSWR) as a function of frequency for the antenna configuration with added capacitive coupling. Indicator 1606 marks the value of VSWR for the LF band (1.33 GHz, 1.26), and indicator 1606 marks the value of VSWR for the HF band (1.57 GHz, 1.09). By comparing FIGS. 16A and 16B, it is clear that the configuration in which there is added capacitive coupling between the HF and the LF radiating elements provides better values of VSWR (closer to 1) for both the HF and LF bands.

Figure 17:
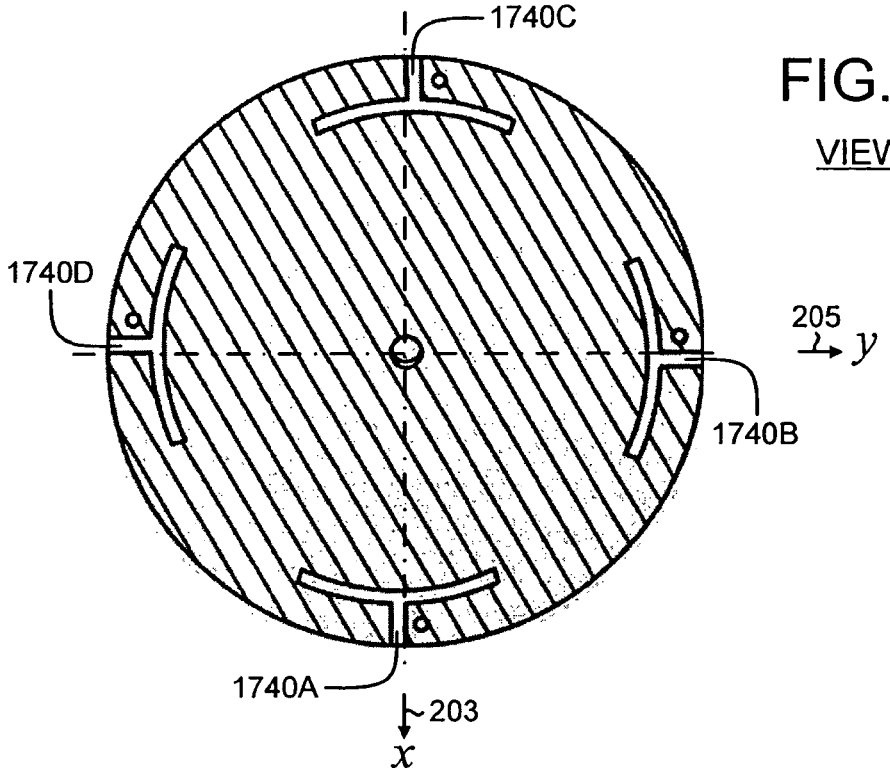
FIG. 17 shows a schematic of a ground plane configured with T-shaped excitation slots.
Figure 18:
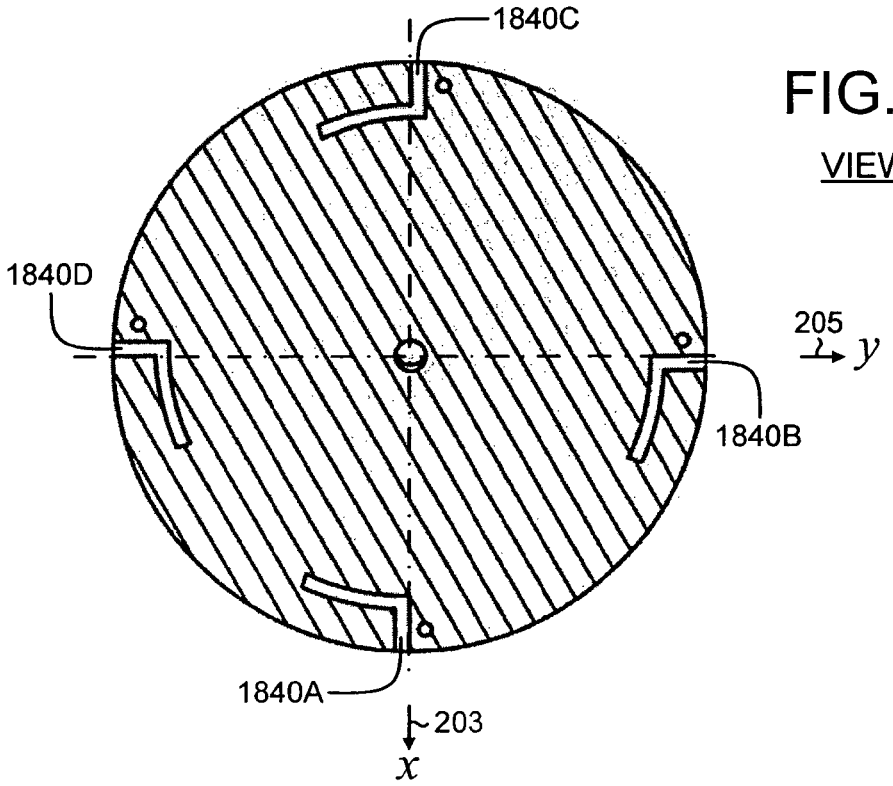
FIG. 18 shows a schematic of a ground plane configured with L-shaped excitation slots.

The input impedance match in both the LF and HF bands can be improved by using different slot geometries in the ground plane. In FIG. 11C, slot 1140A-slot 1140D are rectangular slots. In FIG. 17, slot 1740A slot 1740D are T-shaped slots. In FIG. 18, slot 1840A slot 1840D are L-shaped slots.

Figure 19A:
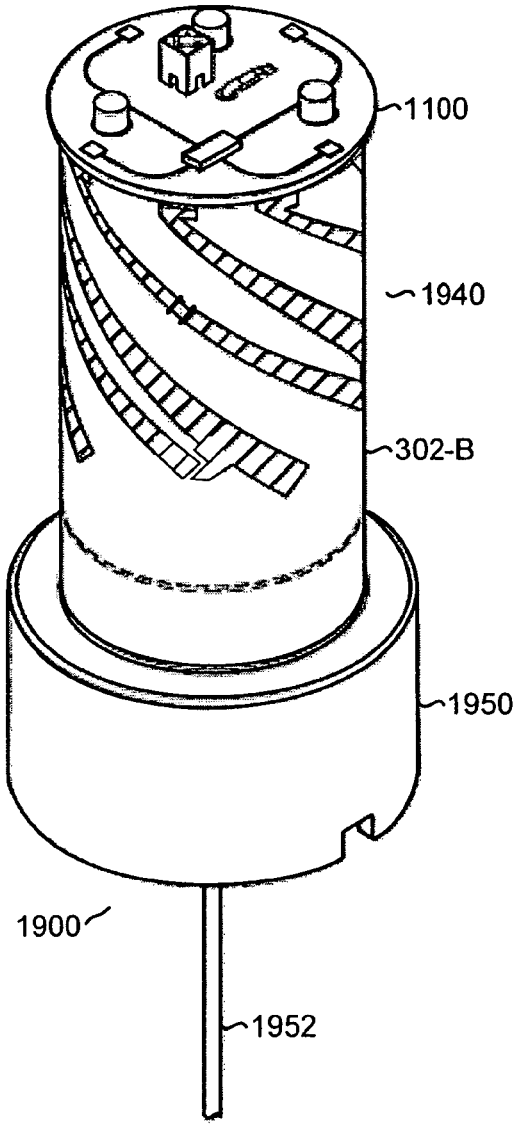

FIG. 19A shows a perspective view of another embodiment of a dual-band antenna. The antenna 1900 includes a radiator 1940, an integrated ground plane and excitation circuit 1100, and a base 1950; to simplify the drawing, not all the details of the integrated ground plane and excitation circuit 1100 are shown. The radiator 1940 includes radiating elements (described below) fabricated on the surface of a dielectric cylindrical tube 302-B. The base 1950 is fabricated from a dielectric material, such as plastic. The coaxial cable 1952 passes through the base 1950 and the interior of the radiator 1940. One end of the center conductor of the coaxial cable 1952 is electrically connected to the excitation circuit. The other end of the coaxial cable 1952 is electrically connected to an antenna port (not shown), as described above.

Figure 19B:
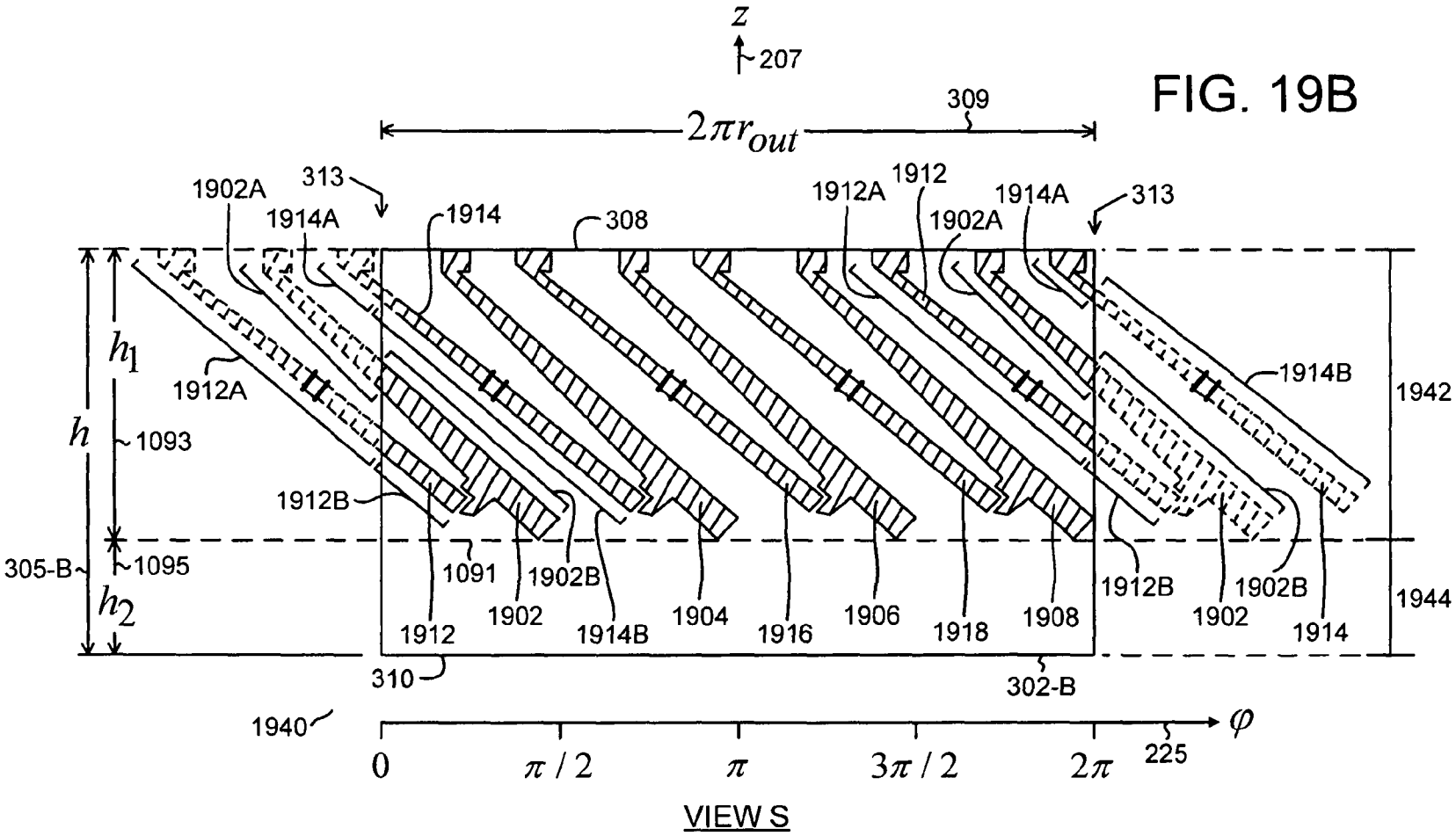

FIG. 19B shows an azimuthal projection (View S) of the radiator 1940. The radiator 1940 includes four pairs of radiating elements for the low-frequency (LF) band and the high-frequency (HF) band. The first pair of radiating elements includes the radiating element 1912 and the radiating element 1902; the second pair of radiating elements includes the radiating element 1914 and the radiating element 1904; the third pair of radiating elements includes the radiating element 1916 and the radiating element 1906; and the fourth pair of radiating elements includes the radiating element 1918 and the radiating element 1908. In this view, the radiating element 1912 is shown as two segments, segment 1912B on the left, and segment 1912A on the right; the radiating element 1902 is shown as two segments, segment 1902B on the left, and segment 1902A on the right; and the radiating element 1914 is shown as two segments, segment 1914B on the left, and segment 1914A on the right. When the dielectric substrate is rolled up into a cylindrical tube, the segment 1912B and the segment 1912A form the continuous radiating element 1912; the segment 1902B and the segment 1902A form the continuous radiating element 1902; and the segment 1914B and the segment 1914A form the continuous radiating element 1914.

Each pair of radiating elements comprises a LF radiating element and a corresponding HF radiating element. FIG. 19C shows a close-up view of a representative pair of radiating element, comprising the radiating element 1916 and the radiating element 1906. FIG. 19D shows a dimensional schematic of the radiating element 1916; and FIG. 19E shows a dimensional schematic of the radiating element 1906.

Refer to FIG. 19C and FIG. 19E. The radiating element 1906 includes the conductive strip 1932 which has two ends. The end 1931 is electrically connected to the contact pad 1930, which in turn is soldered to the ground plane (of the integrated ground plane and excitation circuit 1100). The end 1933 is the free end. The length between the end 1931 and the end 1933 is the length 1935. The conductive strip 1932 has an approximately trapezoidal shape. The linewidth broadens along the length of the radiating element: the linewidth 1939 at the end 1933 is wider than the linewidth 1937 at the end 1931.

Refer to FIG. 19C and FIG. 19D. The radiating element 1916 includes the conductive strip 1922, the HF capacitor 1926, and the conductive strip 1924 electrically connected in series. In general, the radiating element 1916 includes one or more conductive strips and one or more HF capacitors electrically connected in series. Each capacitor can be a lumped circuit element or a distributed circuit element (for example, a capacitor can be fabricated using standard photolithographic techniques from metal film deposited on a dielectric substrate). The radiating element 1916 has two ends. The end 1921 is electrically connected to the contact pad 1920, which in turn is soldered to the ground plane (of the integrated ground plane and excitation circuit 1100). The end 1923 is the free end. The length between the end 1921 and the end 1923 is the length 1925. The radiating element 1916 has an approximately trapezoidal shape. The linewidth broadens along the length of the radiating element: the linewidth 1929 at the end 1923 is wider than the linewidth 1927 at the end 1921.

Refer to FIG. 19C and FIG. 19F. The radiating element 1916 and the radiating element 1906 are capacitively coupled by the coupling capacitor 1960. In the embodiment shown in FIG. 19F, the coupling capacitor 1960 is integrated into the radiating element 1916 and the radiating element 1906. In other embodiments, a separate capacitor can be used. The coupling capacitor 1960 is formed by a portion of the radiating element 1916 and a portion of the radiating element 1906. The portion of the radiating element 1916, represented by the hatched region 1965, is located at the free end 1923. The portion of the radiating element 1906, represented by the hatched region 1963, is located on the side of the radiating element 1906 adjacent to the radiating element 1916. The region 1965 and the region 1963 serves as electrodes separated by the gap 1961, thereby forming a capacitor.

Refer to FIG. 19C and FIG. 19E. The boundary 1940 marks the position of the region 1963 and partitions the conductive strip 1932 into the conductive strip 1934 and the conductive strip 1936. The length of the conductive strip 1934, measured between the end 1931 and the boundary 1940 is the length 1941. The length of the conductive strip 1936, measured between the boundary 1940 and the end 1933 is the length 1943.

Refer to FIG. 19C. The LF current 1953 traverses the radiating element 1906 from the end 1931 to the end 1933 (the LF current is represented by a dashed arrow). Although the radiating element 1906 is fabricated as a single conductive strip 1932, for modelling, the conductive strip 1932 is considered as two conductive strips, the conductive strip 1934 and the conductive strip 1936, electrically connected in series. Therefore, the LF current 1953 traverses the conductive strip 1934 from the end 1931 to the boundary 1940 and traverses the conductive strip 1936 from the boundary 1940 to the end 1933.

The HF current includes three segments, referenced as HF current segment 1951A, HF current segment 1951B, and HF current segment 1951C (the HF current segments are represented by dashed arrows). The HF current segment 1951C traverses the radiating element 1916 from the end 1921 to the end 1923; the HF current segment 1951B traverses the capacitor 1960; and the HF current segment 1951C traverses the conductive strip 1936 in the radiating element 1906 from the boundary 1940 to the end 1933. Note that both the LF current and the HF current flow in the conductive strip 1936. The conductive strip 1936 is referred to herein as the combined-frequency conductive strip.

In principle, the LF current can also flow from the radiating element 1906 through the coupling capacitor 1960 to the radiating element 1916. In practice, however, the coupling capacitor has a substantially greater capacitive reactance for the LF current than for HF current; consequently, the amplitude of the LF current flowing to the radiating element 1916 is negligible.

In this embodiment, the LF radiating element comprises two LF radiating element portions. The first LF radiating element portion is the conductive strip 1934. The second LF radiating element portion is the conductive strip 1936. The conductive strip 1934 and the conductive strip 1936 are electrically connected in series. The LF radiating element has a first end and a second end. The first end is the end 1931, and the second end is the end 1933.

In this embodiment, the HF radiating element comprises three HF radiating element portions. The first HF radiating element portion is the radiating element 1916. The second HF radiating element portion is the coupling capacitor 1960. The third HF radiating element portion is the conductive strip 1936. The radiating element 1916, the coupling capacitor 1960, and the conductive strip 1936 are electrically connected in series. The HF radiating element has a first end and a second end. The first end is the end 1921, and the second end is the end 1933.

Refer to FIG. 19D and FIG. 19E. The length 1925 of the radiating element 1916 is less than the length 1935 of the radiating element 1906. The matching condition $L_{hf}=L_{lf}=L$ then refers to the electrical path lengths. traversed by the HF current and the LF current. For the LF current, the LF electrical path length is the electrical path length between the first end of the LF radiating element and the second end of the LF radiating element; in this instance, the LF electrical path length is equal to length 1935, where length 1935 is equal to the sum of (length 1941+length 1943).

For the HF current, the HF electrical path length is the electrical path length between the first end of the HF radiating element and the second end of the HF radiating element; in this instance, the HF electrical path length is equal to the sum of (length 1925+length across the capacitor 1960+length 1943).

When a radiating element (LF or HF) has only a single portion, the electrical path length of the radiating element is equal to the length of the radiating element, where the length of the radiating element refers to the physical length of the radiating element. For example, refer to FIG. 6A. The electrical path length of the LF radiating element 606 is equal to the length 601; and the electrical path length of the HF radiating element 616 is equal to the length 616.

Refer to FIG. 19C. The azimuthal spacing between the radiating element 1916 and the radiating element 1906 is $(\Delta\phi)_2$ 1911 (measured between the end 1921 of the radiating element 1916 and the end 1931 of the radiating element 1906). In an embodiment, the azimuthal spacing is about 5 deg to about 45 deg.

In the embodiments discussed above, slot excitation of the radiating elements was used. In other embodiments, pin excitation of the radiating elements are used. In the vicinity where a radiating element connects to the ground plane, there is a gap with a pin connected to the excitation circuit. Pin excitation, however, requires balun dividers, which complicate the design and introduce additional losses.

In the embodiments discussed above, the conductive strips were fabricated from metal films deposited on a printed circuit board; low-cost, high-volume manufacturing can be implemented using standard photolithographic techniques. In other embodiments, the conductive strips can be fabricated from wires or sheet-metal strips. The conductive strips can be self-supporting or supported by dielectric posts or a dielectric substrate.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. An antenna configured to operate with circularly-polarized electromagnetic radiation in a low-frequency band and in a high-frequency band, the antenna comprising:

a ground plane; and a radiator comprising four pairs of radiating elements, wherein:

each pair of radiating elements is disposed as a pair of spiral segments on a cylindrical surface having a longitudinal axis orthogonal to the ground plane;

each pair of radiating elements comprises a low-frequency radiating element and a high-frequency radiating element, wherein:

the low-frequency radiating element has a first end and a second end, wherein the first end is electrically connected to the ground plane;

the high-frequency radiating element has a first end and a second end, wherein the first end is electrically connected to the ground plane;

the low-frequency radiating element has a low-frequency electrical path length between the first end of the low-frequency radiating element and the second end of the low-frequency radiating element;

the high-frequency radiating element has a high-frequency electrical path length between the first end of the high-frequency radiating element and the second end of the high-frequency radiating element;

the high-frequency electrical path length is equal to the low-frequency electrical path length;

the low-frequency radiating element comprises a low-frequency conductive strip; and the high-frequency radiating element comprises an electrically-connected series of at least one high-frequency conductive strip and at least one high-frequency capacitor; and the low-frequency electrical path lengths and the high-frequency electrical path lengths of the four pairs of radiating elements are all equal.

2. The antenna of claim 1, wherein:

the low-frequency band includes frequencies from about 1165 MHz to about 1300 MHz; and the high-frequency band includes frequencies from about 1525 MHz to about 1605 MHz.

3. The antenna of claim 1, wherein the electrical path lengths of the low-frequency radiating elements and the electrical path lengths of the high-frequency radiating elements are equal to approximately one-quarter of a wavelength representative of the low-frequency band.

4. The antenna of claim 1, wherein:

the low-frequency conductive strip has a first end and a second end;

the low-frequency conductive strip has a length between the first end of the low-frequency conductive strip and the second end of the low-frequency conductive strip;

the electrical path length of the low-frequency radiating element is equal to the length of the low-frequency conductive strip;

the electrically-connected series of the at least one high-frequency conductive strip and the at least one high-frequency capacitor has a first end and a second end;

the electrically-connected series of the at least one high-frequency conductive strip and the at least one high-frequency capacitor has a length between the first end of the electrically-connected series of the at least one high-frequency conductive strip and the at least one high-frequency capacitor and the second end of the electrically-connected series of the at least one high-frequency conductive strip and the at least one high-frequency capacitor; and the electrical path length of the high-frequency radiating element is equal to the length of the electrically-connected series of the at least one high-frequency conductive strip and the at least one high-frequency capacitor.

5. The antenna of claim 1, wherein:

the low-frequency radiating element further comprises a combined-frequency conductive strip electrically connected in series to the low-frequency conductive strip; and the high-frequency radiating element further comprises a coupling capacitor and the combined-frequency conductive strip, wherein the electrically-connected series of the at least one high-frequency conductive strip and the at least one high-frequency capacitor, the coupling capacitor, and the combined-frequency conductive strip are electrically connected in series.

6. The antenna of claim 5, wherein:

the low-frequency conductive strip has a first end and a second end;

the low-frequency conductive strip has a length between the first end of the low-frequency conductive strip and the second end of the low-frequency conductive strip;

the combined-frequency conductive strip has a first end and a second end;

the combined-frequency conductive strip has a length between the first end of the combined-frequency conductive strip and the second end of the combined-frequency conductive strip;

the electrical path length of the low-frequency radiating element is equal to a sum of the length of the low-frequency conductive strip and the length of the combined-frequency conductive strip;

the electrically-connected series of the at least one high-frequency conductive strip and the at least one high-frequency capacitor has a first end and a second end;

the electrically-connected series of the at least one high-frequency conductive strip and the at least one high-frequency capacitor has a length between the first end of the electrically-connected series of the at least one high-frequency conductive strip and the at least one high-frequency capacitor and the second end of the electrically-connected series of the at least one high-frequency conductive strip and the at least one high-frequency capacitor;

the coupling capacitor has a first end and a second end;

the coupling capacitor has a length between the first end of the coupling capacitor and the second end of the coupling capacitor; and the electrical path length of the high-frequency radiating element is equal to a sum of the length of the electrically-connected series of the at least one high-frequency conductive strip and the at least one high-frequency capacitor, the length of the coupling capacitor, and the length of the combined-frequency conductive strip.

7. The antenna of claim 1, wherein:

an azimuthal separation of the high-frequency radiating element and the low-frequency radiating element is about 5 degrees to about 45 degrees.

8. The antenna of claim 1, wherein:

each low-frequency radiating element has a winding angle and an azimuthal span;

the winding angles of the low-frequency radiating elements are equal;

the azimuthal spans of the low-frequency radiating elements are equal;

each high-frequency radiating element has a winding angle and an azimuthal span;

the winding angles of the high-frequency radiating elements are equal;

and the azimuthal spans of the high-frequency radiating elements are equal.

9. The antenna of claim 8, wherein the winding angles of the high-frequency radiating elements are equal to the winding angles of the low-frequency radiating elements.

10. The antenna of claim 8, wherein the winding angles of the high-frequency radiating elements are not equal to the winding angles of the low-frequency radiating elements.

11. The antenna of claim 8, wherein the azimuthal spans of the high-frequency radiating elements are equal to the azimuthal spans of the low-frequency radiating elements.

12. The antenna of claim 8, wherein the azimuthal spans of the high-frequency radiating elements are not equal to the azimuthal spans of the low-frequency radiating elements.

13. The antenna of claim 8, wherein:

the winding angles of the low-frequency radiating elements are about 40 degrees to about 75 degrees;

the winding angles of the high-frequency radiating elements are about 40 degrees to about 75 degrees;

the azimuthal spans of the low-frequency radiating elements are about 175 degrees to about 212 degrees; and the azimuthal spans of the high-frequency radiating elements are about 175 degrees to about 212 degrees.

14. The antenna of claim 1, wherein:

each low-frequency radiating element has a linewidth increasing from the first end of the low-frequency radiating element to the second end of the low-frequency radiating element; and each high-frequency radiating element has a linewidth increasing from the first end of the high-frequency radiating element to the second end of the high-frequency radiating element.

15. The antenna of claim 1, wherein:

the radiator further comprises a dielectric substrate configured as a cylindrical tube having an outer surface;

the cylindrical surface corresponds to the outer surface of the cylindrical tube;

each low-frequency conductive strip is fabricated from metal film disposed on the outer surface of the cylindrical tube; and each high-frequency conductive strip is fabricated from metal film disposed on the outer surface of the cylindrical tube.

16. The antenna of claim 1, wherein the ground plane comprises a plurality of excitation slots, wherein the plurality of excitation slots comprises an azimuthally-spaced sequence of:

a first excitation slot;

a second excitation slot;

a third excitation slot; and a fourth excitation slot.

17. The antenna of claim 16, wherein the plurality of excitation slots are selected from the group consisting of a plurality of rectangular excitation slots, a plurality of L-shaped excitation slots, and a plurality of T-shaped excitation slots.

18. The antenna of claim 16, wherein:

the high-frequency radiating elements comprise:

a first high-frequency radiating element;

a second high-frequency radiating element;

a third high-frequency radiating element; and a fourth high-frequency radiating element;

the first end of the first high-frequency radiating element is adjacent to the first excitation slot;

the first end of the second high-frequency radiating element is adjacent to the second excitation slot;

the first end of the third high-frequency radiating element is adjacent to the third excitation slot; and the first end of the fourth high-frequency radiating element is adjacent to the fourth excitation slot.

19. The antenna of claim 18, further comprising an excitation circuit operably coupled to the plurality of excitation slots such that:

electromagnetic radiation excited at the second excitation slot is 90 degrees out-of-phase with electromagnetic radiation excited at the first excitation slot;

electromagnetic radiation excited at the third excitation slot is in-phase with electromagnetic radiation excited at the first excitation slot; and electromagnetic radiation excited at the fourth excitation slot is 90 degrees out-of-phase with electromagnetic radiation excited at the first excitation slot.

20. The antenna of claim 19, further comprising a printed circuit board having a bottom side and a top side, wherein:

the ground plane is fabricated on the bottom side of the printed circuit board;

the excitation circuit is fabricated on the top side of the printed circuit board; and the ground plane and the excitation circuit are electrically connected by a plurality of metallized vias passing through the printed circuit board.

21. The antenna of claim 20, wherein:

the excitation circuit comprises:

a quadrature splitter comprising:

a first input port configured to be operably coupled to an antenna port;

a first output port; and a second output port, wherein an electromagnetic signal at the second output port is 90 degrees out-of-phase with an electromagnetic signal at the first output port;

a first balanced divider comprising:

a second input port;

a third output port; and a fourth output port; and a second balanced divider comprising:

a third input port;

a fifth output port; and a sixth output port;

the plurality of metallized vias comprises:

a first metallized via;

a second metallized via;

a third metallized via; and a fourth metallized via;

the first output port is operably coupled to the second input port by a first microstrip line;

the third output port is operably coupled to the first metallized via by a second microstrip line, the first metallized via passes through the printed circuit board, and the first metallized via is operably coupled to the first excitation slot;

the fourth output port is operably coupled to the second metallized via by a third microstrip line, the second metallized via passes through the printed circuit board, and the second metallized via is operably coupled to the third excitation slot;

the second output port is operably coupled to the third input port by a fourth microstrip line;

the fifth output port is operably coupled to the third metallized via by a fifth microstrip line, the third metallized via passes through the printed circuit board, and the third metallized via is operably coupled to the second excitation slot; and the sixth output port is operably coupled to the fourth metallized via by a sixth microstrip line, the fourth metallized via passes through the printed circuit board, and the fourth metallized via is operably coupled to the fourth excitation slot.

22. The antenna of claim 1, wherein:

the radiator further comprises a dielectric substrate configured as a cylindrical tube having a top end face, a bottom end face, and an outer surface, wherein the outer surface comprises a top portion adjacent to the top end face and a bottom portion adjacent to the bottom end face;

the four pairs of radiating elements are disposed on the top portion of the outer surface of the cylindrical tube;

no radiating elements are disposed on the bottom portion of the outer surface of the cylindrical tube; and the antenna further comprises a printed circuit board having a bottom side and a top side, wherein:

the bottom side of the printed circuit board is disposed on the top end face of the cylindrical tube;

the ground plane is fabricated on the bottom side of the printed circuit board;

the ground plane comprises a plurality of excitation slots;

an excitation circuit is fabricated on the top side of the printed circuit board; and the excitation circuit and the plurality of excitation slots are operably coupled by a plurality of metallized vias passing through the printed circuit board.

23. The antenna of claim 22, wherein the bottom end face of the cylindrical tube is disposed on a global navigation satellite system receiver.

* * * * *